US010369578B2

(12) United States Patent
Allard

(10) Patent No.: US 10,369,578 B2
(45) Date of Patent: Aug. 6, 2019

(54) TUBULAR SHOWER APPARATUS, SYSTEMS AND METHODS

(71) Applicant: Gene R. Allard, Island Lake, IL (US)

(72) Inventor: Gene R. Allard, Island Lake, IL (US)

( * ) Notice: Subject to any disclaimer, the term of this patent is extended or adjusted under 35 U.S.C. 154(b) by 833 days.

(21) Appl. No.: 13/935,979

(22) Filed: Jul. 5, 2013

(65) Prior Publication Data

US 2014/0008467 A1 Jan. 9, 2014

Related U.S. Application Data

(60) Provisional application No. 61/668,228, filed on Jul. 5, 2012.

(51) Int. Cl.
*B05B 1/18* (2006.01)
*B05B 1/20* (2006.01)
*B05B 1/16* (2006.01)

(52) U.S. Cl.
CPC ..... *B05B 1/185* (2013.01); *B05B 1/207* (2013.01); *B05B 1/1636* (2013.01); *B05B 1/1672* (2013.01)

(58) Field of Classification Search
CPC ..... F16K 25/00516; F16K 1/42; B05B 1/185; B05B 1/207; B05B 1/1636; B05B 1/1672
USPC ..... 4/567–570; 239/562
See application file for complete search history.

(56) References Cited

U.S. PATENT DOCUMENTS 536,020 A 3/1895 Ebert
759,874 A 5/1904 Fletcher
950,269 A 2/1910 Youngs
1,406,070 A 2/1922 Patton
1,415,014 A * 5/1922 Booth ..... E03C 1/023 251/148
1,443,753 A * 1/1923 McClure ..... A47K 3/30 160/126
1,501,762 A 7/1924 Ferguson
1,758,767 A 4/1929 Taggart
2,060,100 A 11/1936 Michelson
2,161,047 A 6/1939 Holden
(Continued)

FOREIGN PATENT DOCUMENTS

FR 2632488 A1 12/1989
FR 2709940 * 9/1993 ..... A47K 3/24
FR 2724550 * 9/1994 ..... A47K 3/22

OTHER PUBLICATIONS

International Search Report and Written Opinion of the International Searching Authority, PCT Pat. App. No. PCT/US2014/045367; dated Nov. 13, 2014.

*Primary Examiner* — Alexander M Valvis
*Assistant Examiner* — Qingzhang Zhou
(74) *Attorney, Agent, or Firm* — Scherrer Patent & Trademark Law, P.C.; Stephen T. Scherrer; Monique A. Morneault

(57) ABSTRACT

The present invention relates to shower apparatus, systems and methods of using the same. Specifically, the shower apparatus of the present invention comprises embodiments of circular and/or arcuate water dispensing tubes for utilization in a shower. Further, embodiments further include connection and leveling mechanisms and water flow diverters for use in the same. In addition, embodiments further include water dispensing holes disposed within the circular and/or arcuate water dispensing tubes for specialized water distribution and coverage thereof of a user within a shower.

16 Claims, 20 Drawing Sheets

(56) References Cited

U.S. PATENT DOCUMENTS

| | | | | | |
|---|---|---|---|---|---|
| 2,380,665 | A | * | 7/1945 | Morris | A47K 3/30 4/558 |
| 2,614,887 | A | * | 10/1952 | Shields | B05B 1/1672 239/165 |
| 2,665,171 | A | | 1/1954 | Stievater | |
| 2,829,379 | A | | 4/1958 | McGee | |
| 3,971,074 | A | * | 7/1976 | Yxfeldt | A47K 3/287 4/570 |
| 4,142,257 | A | | 3/1979 | Mace | |
| 4,724,553 | A | | 2/1988 | Bianchi | |
| 4,749,130 | A | | 6/1988 | Utzinger | |
| 4,865,254 | A | | 12/1989 | Kragle | |
| 5,148,556 | A | * | 9/1992 | Bottoms, Jr. | A47K 3/281 239/273 |
| 5,205,306 | A | | 4/1993 | Peterson | |
| 5,418,985 | A | | 5/1995 | Antoine | |
| 6,237,167 | B1 | * | 5/2001 | Hunden | A47K 3/28 4/567 |
| 2003/0038184 | A1 | | 2/2003 | Wang | |

* cited by examiner

TUBULAR SHOWER APPARATUS, SYSTEMS AND METHODS

This application claims priority to U.S. Provisional patent application filed under Ser. No. 61/668,228, entitled "Tubular Shower Apparatus, Systems and Methods," filed Jul. 5, 2012, which is incorporated by reference herein in its entirety.

TECHNICAL FIELD

The present invention relates to shower apparatus, systems and methods of using the same. Specifically, the shower apparatus of the present invention comprises embodiments of circular and/or arcuate water dispensing tubes for utilization in a shower. Further, embodiments include connection and leveling mechanisms and water flow diverters for use in the same. In addition, embodiments further include water-dispensing holes disposed within the circular and/or arcuate water dispensing tubes for specialized water distribution and coverage thereof of a user within a shower.

BACKGROUND

It is, of course, generally known to utilize a shower for cleaning an individual. Showers and shower basins, tubs, and the like are common features of residences, and many millions of people utilize a shower every day for maintaining good hygiene.

In a typical arrangement, a shower comprises a pipe for water distribution having a shower head disposed on an end thereof. The shower head may have numerous shapes, but typically a shower head includes a flat or relatively flat planar surface having a plurality of water distribution channels and perforations disposed therein. Water flowing through the pipe is expelled, under pressure, through the water distribution channels and perforations within the shower head, creating a steady rain-like effect of water at a generally constant angle, typically overhead of the user. Thus, an individual may utilize the shower for wetting and rinsing during a cleaning process.

An individual typically turns the water to the shower on, waits for the heated water to flow therethrough (unless cold water is desired or necessary), and enters the shower basin or tub under the stream of water that flows out of the shower head. He or she typically lathers and cleans his or herself with a soap or shampoo, and then proceeds to rinse him or herself off. Upon completion, the individual may turn off the water, dry him or herself, and exit the basin or tub. Water expelled from the shower head typically runs down a drain, with the soap, shampoo and residual dirt and other detritus that may have been cleaned off the individual's body.

Typically, showers are useful in that one may bathe relatively quickly and easily, and the shower is useful in conserving water due to the fact that less water is typically utilized during a shower than a typical bath when cleaning an individual. However, further water conservation is necessary in many areas of the world due to clean water shortages and the like. Thus a need exists for shower apparatus, systems and methods for providing decreased water consumption while maintaining the quickness and ease of cleaning inherent in a shower.

Shower heads are also known that may provide different water flow patterns to allow an individual to select which type of flow pattern is desired. For example, a shower head may have a lever that allows a user to select between a steady flow of water, a pulsed flow of water, smaller water droplets, larger water droplets, or the like.

As noted earlier, it is typical for a shower head to be disposed above a user who typically stands therebeneath for wetting and rinsing. Because of the typical size and distribution of perforations in a shower head, it is typical for a shower head to have a concentrated flow of water droplets out of the shower in a relatively narrow band. Thus, a user, to sufficiently soak his or her body, must constantly shift beneath the shower head to sufficiently wet or rinse his or her body. In addition, because the water tends to be concentrated in a relatively narrow band when ejecting from the shower head, to sufficiently wet the user's body, the user must constantly and simultaneously wet his or her head and hair at the same time. In many cases, users may not wish to wash their hair during a shower, and although shower caps may be useful to keep hair dry, it is often difficult and impractical to try to keep one's hair dry during a shower. A need, therefore, exists for providing shower apparatus, systems and methods for allowing a user's body to be wetted while allowing a user to keep his or her head dry.

Moreover, because the water tends to expel in a relatively narrow band from a shower head, portions of the user's body may be exposed for lengths of time to ambient air conditions. This may be uncomfortable for a user in that the ambient air may be relatively cool or even cold, especially compared to the relative warmth of water expelling from a shower head. Because water tends to be concentrated at the head region of the individual, the individual's head may be uncomfortably warm while portions of the user's body may be uncomfortably cold. In many cases, users may prefer to maintain the exact opposite in a shower: a relatively cool head region, allowing for better breathability and comfort, and relative warmth over the rest of the body, from shoulders to feet. A need, therefore, exists for providing shower apparatus, systems and methods for providing sufficient coverage of water over a user's entire body from shoulders to feet, to minimize cooling of the body by the ambient air. A need further exists for shower apparatus, systems and methods for providing sufficient coverage of water over a user's body while allowing a user's head region to stay relatively free of the water flow.

Because, as noted, typical shower heads tend to expel water in a relatively narrow band, users of different body sizes may have difficulty utilizing the stream of water for bathing purposes. A user having a relatively narrow body shape may have a better ability to wet and rinse him or herself when showering than a user having a relatively larger girth. Thus, a need exists for shower apparatus, systems and methods for allowing for adjustability in the water expulsion band and degree of coverage provided by a water stream within a shower.

Further, a shower head typically provides water expulsion from a relatively concentrated area, with the water distribution band fanning out as the water falls. Users may have relatively narrow shower basins or tubs, and water may spray out of the same, especially if a user opens a door or moves a curtain to enter the shower space. Moreover, water spraying and/or fanning outwardly may hit and wet shower walls, tub walls, shower doors, and the like causing significant wear and tear on these parts. A further need, therefore, exists for shower apparatus, systems and methods for controlling the water distribution band of water as it falls from a shower head, thereby keeping the water within the center of the desired shower or tub so that the water may properly flow down a drain, and keeping water from needlessly hitting shower or tub walls, doors and the like thereby causing long-term wear and tear. Still further, a need exists for shower apparatus, systems and methods for changing a water distribution band as water expels from the shower apparatus, depending on whether relatively narrow water distribution bands or relatively wide water distribution bands are desired.

Traditional shower heads tend to push water downwardly from a central location onto a user's body. The water is typically heated, and the pressure differential caused by both the movement of the water and the heat from the water typically causes air to push outwardly away from the user. This may cause discomfort as colder air may rush toward the user's body making the user cold, even as the warm water hits the user. Moreover, because the water typically expels from a relatively central location on a traditional shower head, while the user's body may be relatively cool, when it is desired to be warm, the user's head may be relatively warm, from the direct flow of water thereon, when it is desired to have the user's head remain relatively cool. A need, therefore, exists for a shower head that allows the user's body to maintain warmth, but further allows the user to maintain relatively cool temperatures on the user's head and/or neck region, thereby providing easier breathing and the like due to the cooler temperatures.

Relatedly, because the water in a traditional shower head is directed directly onto a user's head or neck, it is difficult to apply shampoo or conditioner, keep conditioner in hair for a time, or to shave the face thereof, without having to avoid the water spray from the shower head. A user may accomplish the same by physically moving the shower head away from his or her body completely, causing discomfort from relatively cold air temperature, or the user must step out of the shower stream, again causing discomfort from relatively cold air temperature. A further need, therefore, exists for shower apparatus, systems and methods for allowing a user to apply shampoo, conditioner, soap, shaving cream, or the like to the users head and/or neck region without diverting the stream of water from the user's body, or stepping out of the stream of water.

Typical showers may utilize a significant amount of water. It is common for a shower taker to utilize up to about 20 gallons of water, even in an eight-minute shower. Many traditional shower heads do not restrict the amount of water flowing therethrough; so much water may be utilized in a shower than is necessary. Some USA shower heads are restricted to 2.5 gallons per minute. An additional need, therefore, exists for shower apparatus, systems and methods for reducing water consumption lower than 2.5 gallons per minute without sacrificing comfort as a user takes a shower.

SUMMARY OF THE INVENTION

The present invention relates to shower apparatus, systems and methods of using the same. Specifically, the shower apparatus of the present invention comprises embodiments of circular and/or arcuate water dispensing tubes for utilization in a shower. Further, embodiments include connection and leveling mechanisms and water flow diverters for use in the same. In addition, embodiments further include water dispensing holes disposed within the circular and/or arcuate water dispensing tubes for specialized water distribution and coverage thereof of a user within a shower.

To this end, in an embodiment of the present invention, a shower apparatus is provided. The shower apparatus comprises a circular or arcuate tube interconnected to a water distribution pipe extending from a wall within a shower basin or tub. The circular or arcuate tube comprises a plurality of perforations through which water may flow.

In another embodiment of the present invention, a shower system is provided comprising a shower apparatus comprising a circular or arcuate tube interconnected to a water distribution pipe, and a traditional shower head interconnected to the water distribution pipe, and a diverter allowing various amounts of water to flow through the shower apparatus and the traditional shower head.

It is, therefore, an advantage and objective of the present invention to provide shower apparatus, systems and methods for controlling water distribution within a shower basin or tub from an overhead shower head at the shower head itself.

Moreover, it is an advantage and objective of the present invention to provide shower apparatus, systems and methods for allowing a user's body to be wetted while allowing a user to keep his or her head dry.

In addition, it is an advantage and objection of the present invention to provide shower apparatus, systems and methods for providing sufficient coverage of water over a user's body, from shoulders to feet, to minimize cooling of the body by the ambient air.

And, it is an advantage and objective of the present invention to provide shower apparatus, systems and methods for providing sufficient coverage of water over a user's body while allowing a user's head region to stay relatively free of the water flow for increased comfort and breathability.

It is a further advantage and objective of the present invention to provide shower apparatus, systems and methods for allowing for adjustability in the water expulsion band and degree of coverage provided by a water stream within a shower.

Moreover, it is an advantage and objective of the present invention to provide shower apparatus, systems and methods for controlling the water distribution band of water as it falls from a shower head, thereby keeping the water within the desired shower or tub so that the water may properly flow down a drain, and keeping water falling inwardly from needlessly hitting shower or tub walls, doors and the like thereby causing long-term wear and tear.

Still further, it is an advantage and objective of the present invention to provide shower apparatus, systems and methods for changing a water distribution band as water expels from the shower apparatus, depending on whether relatively narrow water distribution bands or relatively wide water distribution bands are desired.

Moreover, it is an advantage and objective of the present invention to provide shower apparatus, systems and methods that allows the user's body to maintain warmth, but further allows the user to maintain relatively cool temperatures on the user's head and/or neck region, thereby providing easier breathing and the like due to the cooler temperatures.

A further advantage and objective of the present invention is provided for shower apparatus, systems and methods for allowing a user to experience improved visual observation while applying shampoo, conditioner, soap, shaving cream, or the like to the users head and/or neck region without diverting the stream of water from the user's body, or stepping out of the stream of water.

An additional advantage and objective exists for the present invention for providing shower apparatus, systems and methods for reducing water consumption without sacrificing comfort as a user takes a shower.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to shower apparatus, systems and methods of using the same. Specifically, the shower apparatus of the present invention comprises embodiments of hoop, circular and/or arcuate water dispensing tubes for utilization in a shower. Further, embodiments include connection and leveling mechanisms and water flow diverters for use in the same. In addition, embodiments further include water dispensing holes disposed within the circular and/or arcuate water dispensing tubes for specialized water distribution and coverage thereof of a user within a shower.

While the present invention relates to water and water flow, any material may be utilized without altering the teachings of the present invention.

Figure 1A:
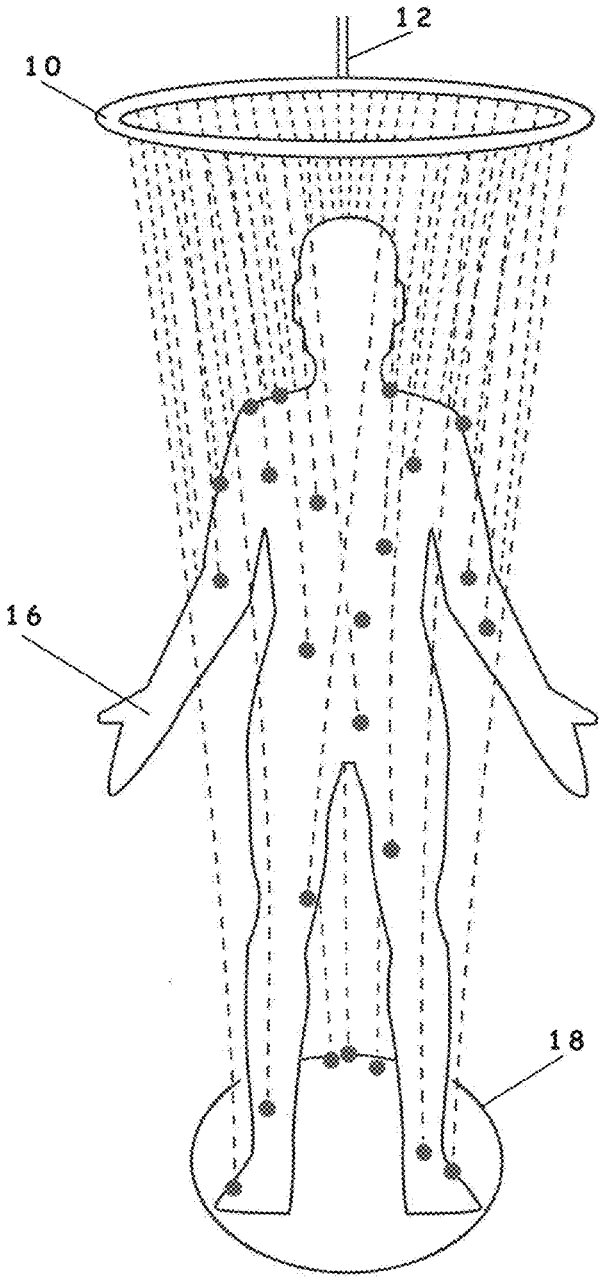
FIGS. 1A and 1B illustrate a tubular shower apparatus in an embodiment of the present invention.
Figure 1B:
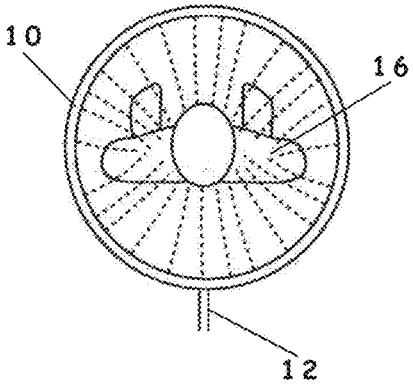

Now referring to the figures, wherein like numerals refer to like parts, FIGS. 1A, 1B illustrate an embodiment of the present invention of a tubular shower head 10. The tubular shower head 10 may form a hoop shape, as illustrated in the drawings, and may extend from a water distribution pipe 12. It should be noted that the term "hoop" may include circular, oval-shaped, or other like shapes, including polygonal shapes such as triangles, squares, rectangles, and other polygons. The tubular shower head 10 may additionally have vertical components to support the hoop as described further below.

The water distribution pipe 12 may further extend from a diverter (not shown in FIGS. 1A, 1B) that may further be attached to a regular or traditional shower head. Thus, a user 16, as illustrated in FIGS. 1A, 1B, may utilize either or both of the tubular shower head 10, the traditional shower head (not shown), or both at the same time. Examples of diverters that may be used for this purpose are illustrated in FIGS. 13, 14, 16, 18 and further described below.

In use, water from the water distribution pipe 12 travels to the tubular shower head 10 and fills the same with water. Distribution holes or channels may be disposed in the tubular shower head 10 to expel water at various placed and intervals in the tubular shower head 10 to create a ring of water droplets that may fall onto the user 16. In an embodiment, the holes or channels may be disposed on an underside of the tubular shower head 10 to allow water to expel therefrom and fall directly downwardly by gravity. In an alternate embodiment, illustrated in FIGS. 2A, 2B, 2C, the holes may be disposed on a top side of the tubular shower head 10 to allow water to expel upwardly therefrom as a fountain, and then fall downward under the force of gravity to form a ring of falling water droplets.

As shown in FIGS. 1A, 1B, water expelling from the holes disposed within the tubular shower head 10 may fall in such a manner as to wet the body of the user 16, but keep the user's head and/or neck area free from water. This may allow the user 16 to enjoy being showered with water droplets over his or her body without having water running down his or her face, or wetting his or her hair at the same time. Advantageously, the user 16 may maintain warmth over his or her body, while allowing his or her head and/or neck to remain relatively cool. Of course, the user 16 may utilize the tubular shower head 10 in such a manner for any other purpose, such as for keeping his or her hair from becoming wet, for rinsing the body without rinsing the head, or for any other purpose.

In a preferred embodiment, the radius of the tubular shower head 10 may be large enough to allow the user 16 to stand thereunder to provide the desired distribution of water over his or her body. As shown in FIGS. 1A, 1B, the radius of the tubular shower head 10 may be as large or larger than the length from shoulder to shoulder, or length from hip to hip, to ensure a preferred distribution of water around the body's hips to the legs and feet.

Moreover, as illustrated in FIGS. 1A, 1B, the water distribution zone, also called the "droplet sprinkler zone" 18, may or may not be influenced by the pressure of the water flowing through the tubular shower head 10. As illustrated in FIG. 1B, maintaining the head and/or neck area free of water may occur whether the water pressure is relatively high or relatively low. As illustrated in FIGS. 2B, 2C, however, the use of tubular shower head 20 in a "fountain configuration" (with the holes disposed on the top of the tube, said holes may be directed inwardly), relatively high or low pressure may have an influence on the water distribution zone of water expelling from the tubular shower head 20. As illustrated in FIG. 2B, a relatively high pressure water expelling from the tubular shower head 20 may cause water droplets to fall on the entirety of the user 26, including the head and/or neck area. Alternatively, if relatively low pressure water is expelled from the tubular shower head 10, the head and/or neck are may remain void of water, and yet still may fall inside the water distribution zone.

Figure 2A:
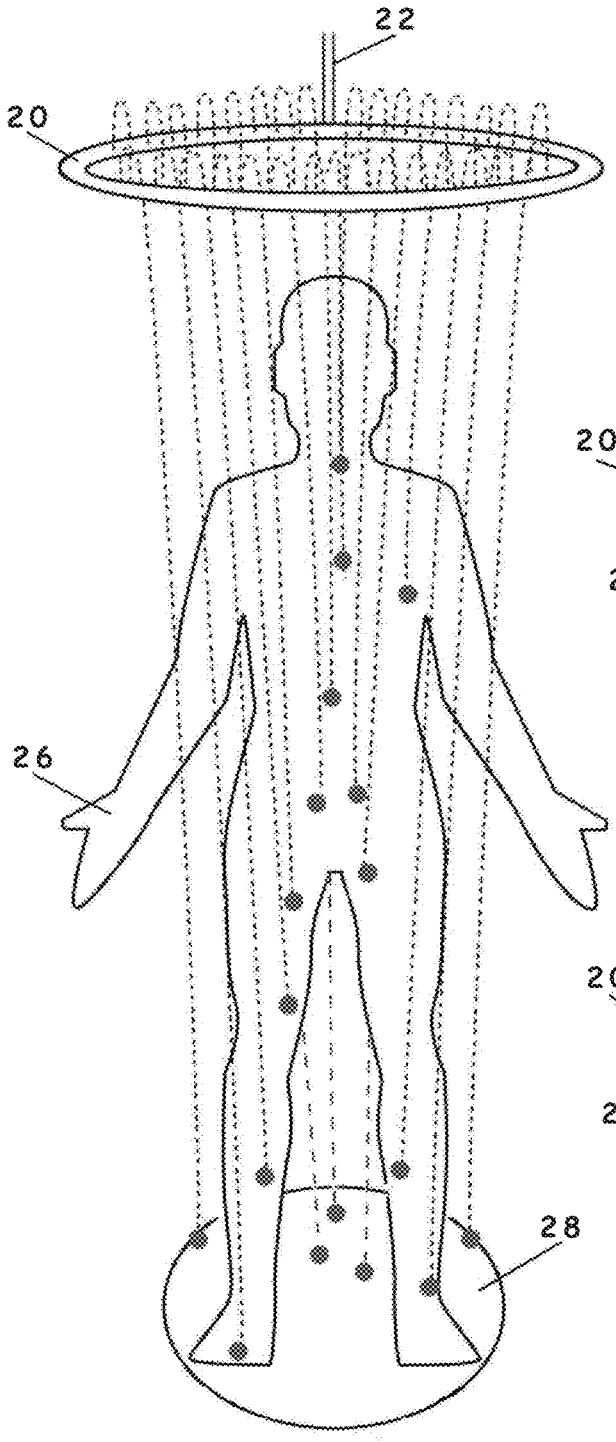
FIGS. 2A-2C illustrate a tubular shower apparatus utilized in a fountain arrangement in an embodiment of the present invention.
Figure 2B:
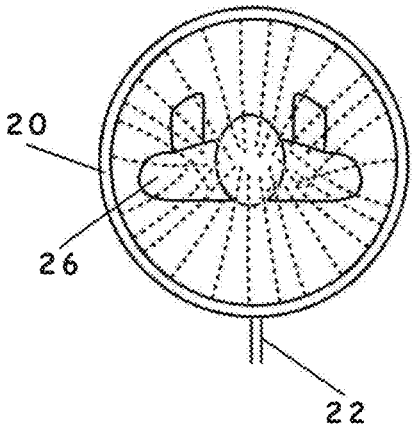
Figure 2C:
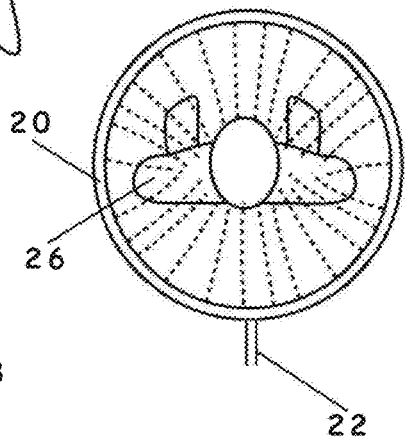

The embodiments shown in FIGS. 1A, 1B and 2A-2C may be interchangeable in that the tubular shower head 10, illustrated in FIGS. 1A, 1B may simply be rotated around to form the tubular shower head 20, illustrated in FIGS. 2A-2C. Thus, the tubular shower head 10 may be affixed or interconnected with a rotating linkage, such as a rotating joint, to allow the degree of freedom of movement required to rotated therearound. The rotating linkage may preferably be where the tubular shower head 10 (or 20) meets the water distribution pipe 12 (or 22). Of course, the rotating linkage may be disposed in any location to allow the tubular shower head 10 (or 20) to rotate as desired. Additionally, the tubular shower head 10 may have multiple hole and direct water flow upwardly or downwardly by an additional diverter control, such that the tubular shower head 10 would not have to be rotated.

As will be described more fully below, the water distribution holes or channels that may be disposed in the tubular shower head 10 may preferably be disposed within the tubular shower head 10 to allow water to expel therefrom. In a preferred embodiment, the holes or channels may further be disposed directly downwardly so that, even when water pressure is decreased or removed, water may still drain from the tubular shower head 10. In an alternate embodiment, the holes or channels may be inwardly disposed on the tubular shower head 10 to direct water inwardly toward the user 16 standing thereunder. Additionally, some holes or channels may be disposed directly downwardly and some holes or channels may be disposed inwardly if the user wishes to have water from multiple angles.

Moreover, a plurality of sizes of holes or channels may be utilized to control the flow of water therefrom, as shown in FIG. 5. For example, relatively small holes may be disposed if the user wishes for relatively small water droplet sizes. Moreover, relatively large holes may be disposed if the user wishes for relatively large water droplet sizes. A mixture of both relatively small holes and relatively large holes may be disposed if the user wishes to have a mixture of relatively small and relatively large water droplet sizes. In general, relatively small water droplet sizes may create a misting effect, which may be desired. However, it is apparent to those of ordinary skill in the art that smaller droplet sizes typically do not maintain heat compared to larger water droplet sizes, so a user may feel chilled if the water droplet sizes are too small.

Although the tubular shower head 10 and the tubular shower head 20 are illustrated as hoops, or circular, the tubular shower heads of the present invention may be any shape apparent to one of ordinary skill in the art to achieve the objectives and advantages provided herein. For example, the tubular shower heads described herein may be oval, square, rectangular, polygonal (such as hexagonal or octagonal, for example), or the like and the present invention should not be limited as described herein.

Moreover, the shower heads described herein as being "tubular" may have any shape in cross-section as long as the shapes utilized achieve the advantages and objectives described herein. For example, the shower heads may preferably be round in cross-section, but may also be oval, square, rectangular, polygonal (such as, for example, hexagonal or octagonal), or the like. Utilizing a tubular shower head having planar faces in cross-section may be useful for disposing the holes and/or channels therein, as planar face may be generally easier to dispose the holes therein than an arcuate face.

Figure 3A:
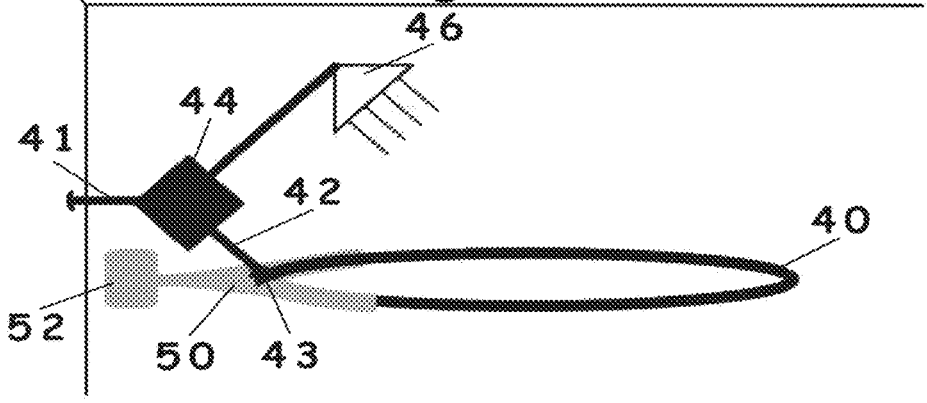
FIGS. 3A-3C illustrate counterbalanced and pivotable tubular shower apparatuses in embodiments of the present invention.
Figure 3B:
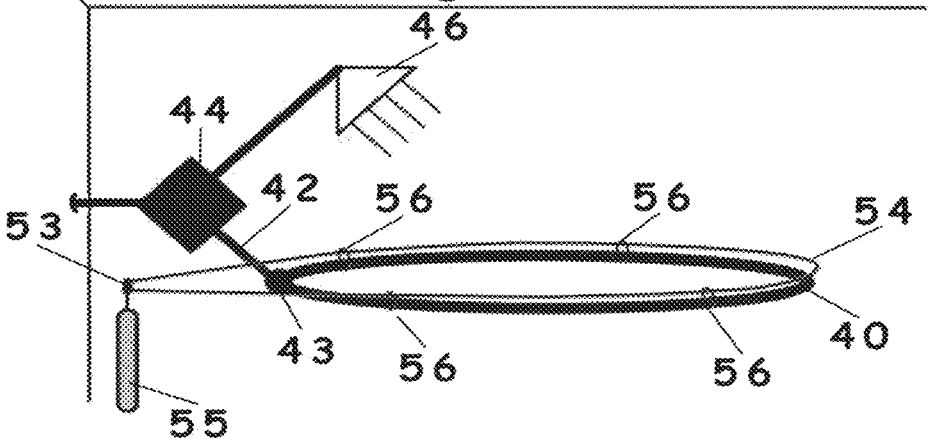
Figure 3C:
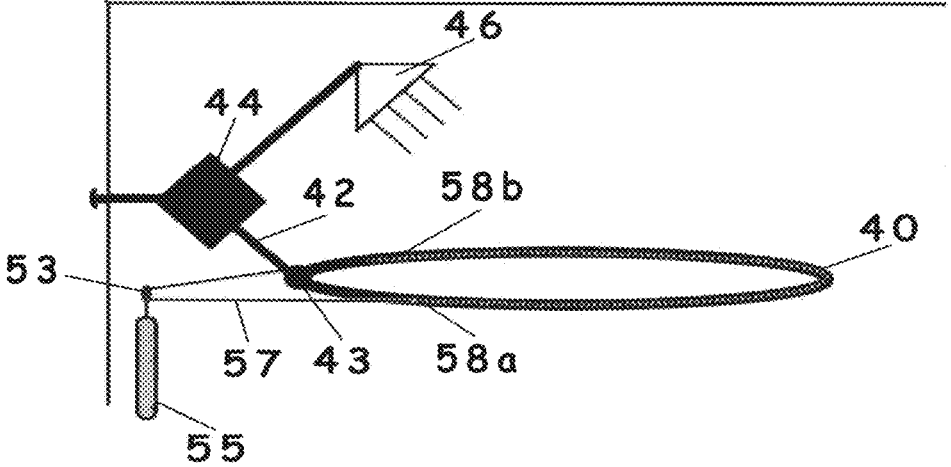

Now referring to FIGS. 3A-3C, alternate embodiments of a tubular shower head 40 is illustrated. The tubular shower head 40 may be as described in earlier embodiments herein. Specifically, as illustrated in FIG. 3A, the tubular shower head 40 may be interconnected to a water distribution pipe 42 that may extend from a diverter 44. The diverter may provide a user the ability to divert water to the tubular shower head 40, a traditional shower head 46 or to both the tubular shower head 40 and the traditional shower head 46, as may be desired. The diverter may be interconnected to a shower arm 41 protruding from the shower wall, as illustrated in FIG. 3A. The shower arm may be a standard pipe extending from the wall for the distribution of water to the diverter 44. Traditionally, shower arms extend downwardly at an angle of 45 degrees. However, it should be noted that the shower arm may extend from the wall at any angle necessary to properly configure the parts of the shower systems described herein, whether at a traditional angle or straight out of the wall at a ninety degree angle, as shown in FIG. 3A, or any other angle apparent to one of ordinary skill in the art.

Alternatively, the shower arm 41 may be attached to a slide device (not shown) that may allow the tubular shower head 40 and the traditional shower head 46 to be moved vertically. Alternately, the tubular shower head 40 may be attached to the slide device individually such that the tubular shower head 40 may independently move vertically. Additionally, the traditional shower head 46 may be attached to the slide device individually such that the traditional shower head 46 may independently move vertically.

The tubular shower head 40 may have a single pivoting hinge 43 disposed at or near the location of the connection between the tubular shower head 40 and the water distribution pipe 42. However, the present invention should not be limited to a single hinge, as other embodiments, especially those noted below, may have a plurality of hinges for additional degrees of freedom of movement of the tubular shower head 40, as described below in FIGS. 11-12. Pivoting the tubular shower head 40 may allow for different patterns of water distribution to fall on the user. For example, tilting the tubular shower head 40 so that its forward end (furthest from the pivoting hinge 43) is higher than the rearward end (at the pivoting hinge 43) may allow a pattern of water distribution to fall on the user that is more heavily concentrated toward the user's body nearest the pivoting hinge 43. Alternatively, tilting the tubular shower head 40 so that its forward end is lower than the rearward end may allow pattern of water distribution to fall on the user that is more heavily concentrated toward the user's body nearest the forward end of the tubular shower head 40.

A leveling mechanism such as a counterbalance 50 may be provided extending outwardly from the tubular shower head 40, and may be positioned beneath the diverter and/or traditional shower head 46. The counterbalance 50 may allow the tubular shower head 40 to maintain its position when utilized by a user, without the need of a support line on an opposite end thereof. The counterbalance 50 may be weighted to provide the tubular shower head 40 with neutrality when moving and positioning the same. The counterbalance 50 may have a weight disposed therein, or may be made from one or a plurality of pipes that may fill with water at the same time that the tubular shower head 40 fills with water, thereby maintaining neutrality of the tubular shower head 40 at the same time that the tubular shower head 40 fills with water.

The counterbalance 50 may further have a handle 52 and/or an easily grippable surface for a user to manipulate the same. Thus, the user may easily manipulate the position of the tubular shower head 40 by pivoting the same upwardly or downwardly via the pivoting hinge 43 by holding a moving the handle 52 on the counterbalance 50. The counterbalance 50 may be integrally formed with the tubular shower head 40 and may be molded therewith, or permanently adhered to the tubular shower head 40. Alternatively, the counterbalance 50 may be shaped to "snap on" to the tubular shower head 40, and may be removable therefrom if desired.

FIG. 3B illustrates an alternate embodiment of a tubular shower head 40 that may have a brace such as a rigid rod 54 that may extend around the perimeter of the tubular shower head 40 and terminating at a point 53 where a leveling mechanism such as a handle and/or counterweight 55 may be attached thereto. The rigid rod 54 may be made from metal, plastic, fiberglass, or other like material that may be formed in the same general shape as the tubular shower head 40, and may be attached to the tubular shower head 40 via attachments 56. The attachments may be clips, loops, or other like means for holding the rigid rod 54 to the tubular shower head 40 and supporting the same or otherwise aiding the tubular shower head 40 to keep its shape. Thus, the rigid rod 54 may provide support for a flexible tubular shower head. The handle/counterbalance 55 may be utilized to tilt the tubular shower head 40 upwardly or downwardly depending on desired water distribution patterns via hinge 43.

Figure 17:
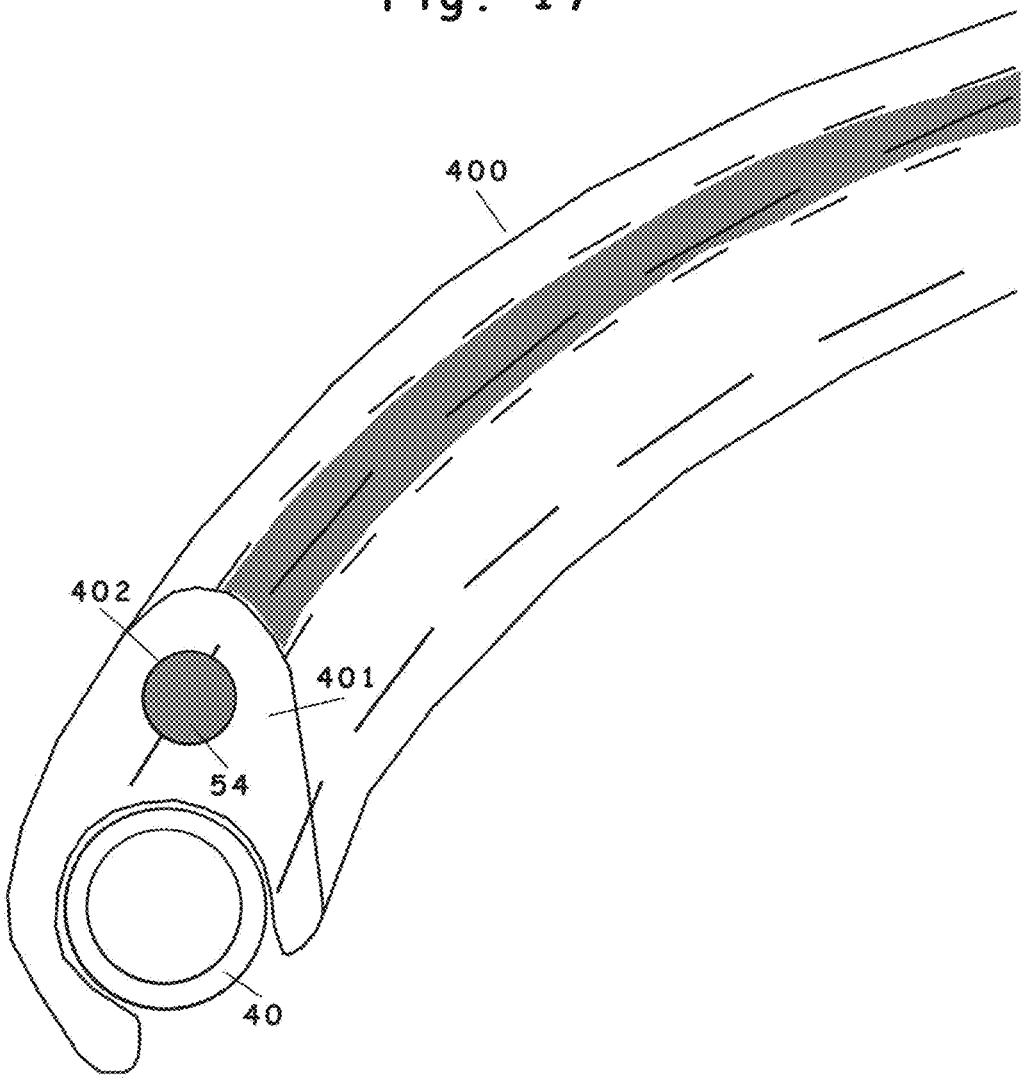
FIG. 17 illustrates an alternate leveling mechanism in an embodiment of the present invention.

Alternatively, the rigid rod 54 may be encased in a vertical component 401 of a support tube 400 that may partially cover and attach around the tubular shower head 40 shown in FIG. 17. Of course, the support tube 400 and the tubular shower head 40 may also be molded together so as to be one piece. The support tube 400 may have a void 402 in the vertical component 401 of the support tube 400 wherein the rigid rod 54 may be disposed. Alternatively, the vertical component 401 of the support tube 400 may be completely solid and extend to a point (not shown) away from the tubular shower head 40. In this alternative embodiment, the vertical component 401 of the support tube 400 may replace the functionality of the rigid rod 54. The vertical component 401 may be freely shaped as shown in FIG. 17, but may be of any shape known to one skilled in the art. For example, the vertical component 401 may be a rectangular protrusion. Additionally the vertical component 401 may protrude directly above the support tube 400 or at any angle such that water flow is not blocked or hindered in any way.

In an alternate embodiment of the present invention, illustrated in FIG. 3C, a rigid rod 57 may be of the same general shape and curvature of the tubular shower head 40, but may extend both outside the tubular shower head 40 and inside the tubular shower head 40. As illustrated, the rigid rod 57 may extend within the tubular shower head 40 and extend through openings 58*a*, 58*b* in the tubular shower head 40. The ends of the rigid rod 57 may extend to the common point 53, wherein the handle and/or counterweight 55 may be disposed.

The rigid rod 57 may be made from metal, plastic, fiberglass, or any other material apparent to one of ordinary skill in the art. Preferably, the rigid rod 57 may have a size to easily fit within the tubular shower head 40, but still allow water to flow therethrough from the water distribution pipe 42. The rigid rod 57 may take up space that would otherwise be filled with water, allowing for a lighter tubular shower head 40 when filled with water. In addition, by filling the space within the tubular shower head 40 with the rigid rod 57, water pressure may be effectively increased without the need for moving a larger amount of water therethrough.

The rigid rod 57 may be sealed at the openings 58*a*, 58*b* so that water does not leak therefrom. Specifically, the openings 58*a*, 58*b* may be sized to snugly fit the rigid rod 57, effectively sealing the openings 58*a*, 58*b*. Alternatively, a sealant or gasket may be used to ensure that water does not leak therefrom.

By effectively reducing the weight of the tubular shower head 40 when filled with water via the rigid rod 57, a smaller counterbalance may be utilized to balance the tubular shower head 40 when in use. This may allow for more control of the tubular shower head 40 and its level via hinge 43 when in use.

Figure 18:
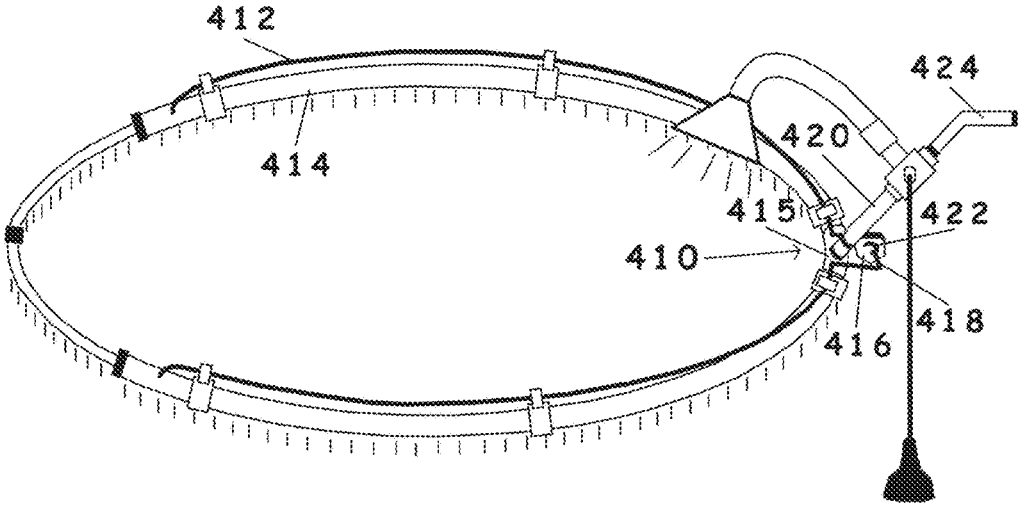
FIG. 18 illustrates an alternate leveling mechanism in a preferred embodiment of the present invention.

In a preferred embodiment seen in FIG. 18, a leveling mechanism 410 is shown and described. The leveling mechanism 410 may comprise a rigid rod 412 that attaches to a tubular shower head 414 and a rotating polygonal wedge 416. The rigid rod 412 may surround the outside of tubular shower head 414 at the sides, or the rigid rod 412 may be disposed above the tubular shower head 414. The rigid rod 412 may be generally the same shape of the tubular shower head 414 with the exception of an extension 418. The extension 418 may avoid a water distribution pipe 420 by extending behind the water distribution pipe 420, as shown in FIG. 18. The water distribution pipe 420 may attach to the tubular shower head 414 at a pivot point 415. Of course, the extension 418 may alternatively extend above the water distribution pipe 420, as further described below. The rotating polygonal wedge 416 may be made from a rigid material, such as a metal, rubber, or plastic material, and may be disposed behind the water distribution pipe 420. The extension 418 of the rigid rod 412 may be disposed within an adjustment slot 422 disposed within the rotating polygonal wedge 416 that is further shown in FIG. 19. The rotating polygonal wedge 416 may have one side of the polygon abut the water distribution pipe 420. The rotating polygonal wedge 416 preferably does not freely rotate because each side of the rotating polygonal wedge 416 may be flat like the sides of a polygon. However, the rotating polygonal wedge 416 may rotate when external force is applied, such as with manual force from a user. The rotating polygonal wedge 416 may rotate about the fulcrum created when two sides of a polygon meet.

Normally the weight of the tubular shower head 414 and any water therein would cause the tubular shower head 414 to rotate about the pivot point 415 and cause the tubular shower head 414 to decline below the horizontal plane and cause the extension 418 to rise above the horizontal plane. However, the placement of the rotating polygonal wedge 416 between the extension 418 and water distribution pipe 420 prevents the extension 418 from rising above the horizontal plane. The extension 418 may apply force on the rotating polygonal wedge 416 that may be negated by force from the water distribution pipe 420. This compression force may not compress the rotating polygonal wedge 416 because of its rigid nature. Thus, the leveling mechanism may prevent the tubular shower head 414 from declining below the horizontal plane effectively supporting the weight of the tubular shower head 414 and any water therein.

Alternatively, the extension 418 may extend above the water distribution pipe 420, wherein the extension 418 would normally rotate away from the water distribution pipe 420 due to the weight of the tubular shower head 414 and any water therein. In this embodiment, a screw, spring, or other tensile force leveling mechanism may be used between the extension 418 and the water distribution pipe 420. A rotating polygonal wedge 416 may be used, however, must be attached to the water distribution pipe 420 so that the rotating polygonal wedge 416 may still rotate. A mirroring adjustment slot (not shown) may be necessary to attach the rotating polygonal wedge 416 to the water distribution pipe while allowing the extension 418 to progress through the adjustment slot 422. The extension 418 may apply force away from the rotating polygonal wedge 416 that may be negated by a pulling force from the water distribution pipe 420. This tension force may not pull the rotating polygonal wedge 416 apart because of its rigid nature. Thus, the leveling mechanism may prevent the tubular shower head 414 from declining below the horizontal plane effectively supporting the weight of the tubular shower head 414 and any water therein.

The tubular shower head 414 may be attached to a supply shower arm 424 that may be disposed within a wall (not shown). The shower supply arm 424 may be angled at 45° as shown in FIG. 18, but it may be 0°, 90°, or any other angle. The rotating polygonal wedge 416 may be rotated to manually adjust the tubular shower head 414 to level so that differing shower supply arm angles can be accommodated. A handle or knob (not shown) may be added, such as to the center of the rotating polygonal wedge 416, to make rotation of the rotating polygonal wedge 416 easier.

Figure 19:
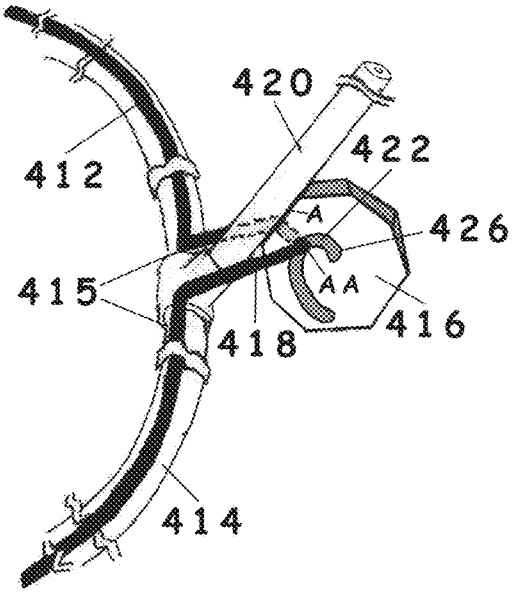
FIG. 19 illustrates a close up view of the alternate leveling mechanism in a preferred embodiment of the present invention.

As shown in FIG. 19, the adjustment slot 422 disposed within the rotating polygonal wedge 416 may be arcuate or spiral and approach the center of the rotating polygonal wedge 416. The extension 418 of the rigid rod 412 may be disposed within the adjustment slot 422. The extension 418 may move within the adjustment slot 422. Specifically, the extension 418 may be within the section of the adjustment slot 422 that corresponds to the side of the rotating polygonal wedge 416 that is abutting the water distribution pipe 420. For example, if side A of the rotating polygonal wedge 416 is abutting the water distribution pipe 420, then the extension 418 would be at spiral position AA. The extension 418 may apply force to an outer wall 426 of the adjustment slot 422 when in use. When the rotating polygonal wedge 416 is rotated, the extension 418 may progress through the adjustment slot 422. When the rotating polygonal wedge 416 is rotated counter-clockwise, the extension 418 may progress through the adjustment slot 422 towards the center of the rotating polygonal wedge 416, and the tubular shower head 414 may rotate clockwise. When the rotating polygonal wedge 416 is rotated clockwise, the extension 418 may progress through the adjustment slot 422 away from the center of the rotating polygonal wedge 416, and the tubular shower head 414 may rotate counter-clockwise. A user may rotate the rotating polygonal wedge 416 clockwise or counter-clockwise to adjust the tubular shower head 414 as desired.

The leveling mechanism may have, instead of a polygonal wedge, a brace, a corkscrew, a support line, a screw, a ratchet, a spring, a counter weight, a gear, or other method known to one skilled in the art to adjust the tubular shower head 414 to horizontal level.

Figure 4:
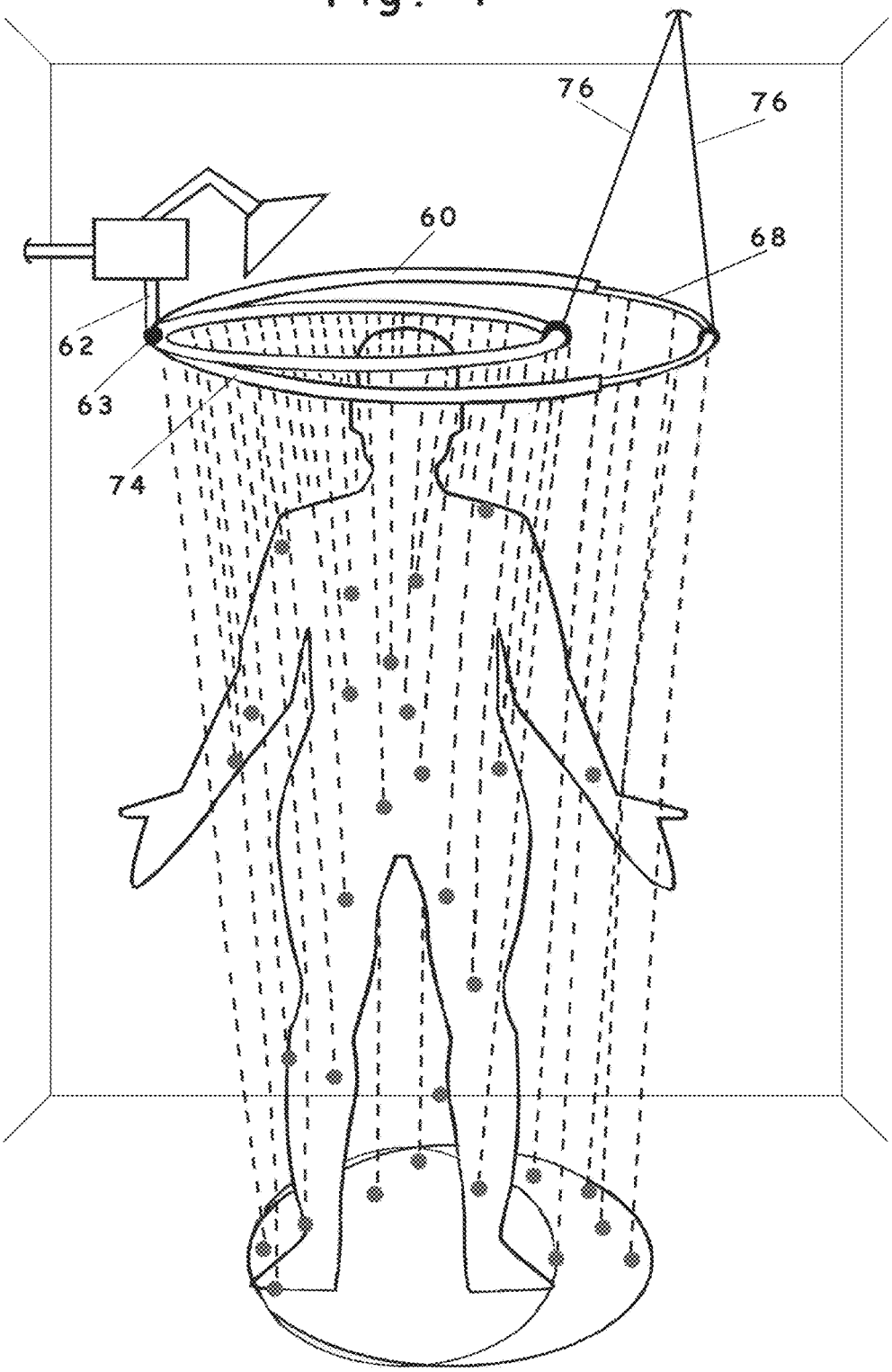
FIG. 4 illustrates an expanding tubular shower head apparatus in an embodiment of the present invention.

FIG. 4 illustrates another embodiment of a tubular shower head 60, being divided at a point opposite the connection of the shower head 60 to a water distribution pipe 62. The tubular shower head 60 may be fixedly attached to water distribution pipe 62, or, in the alternative, may be hingedly connected thereto via hinge 63 for hinged movement as well as rotational movement of the tubular shower head 60.

The tubular shower head 60 may be bifurcated, thereby forming an outer tube 74 and an inner tube 68 that may be slideably disposed within the outer tube 74. FIG. 4 illustrates a first position of the outer tube 74 having the inner tube 68 disposed fully or nearly fully within the same, thereby forming a tubular ring having a first diameter. This may be useful for users who may wish to have a smaller ring of water droplets falling thereon, such as, for example, for users having smaller body sizes.

FIG. 4 further illustrates a second position of the outer tube 74 having the inner tube 68 fully extended from the outer tube 74 forming a tubular ring having a second diameter larger than the first diameter. This may be useful for users who may wish to have a larger ring of water droplets falling thereon, such as, for example, for users having larger body sizes. The inner tube 68 may be extended from the outer tube 74 only partially to form tubular rings having diameters between the first position and the second position, as noted above.

As noted above, the inner tube 68 may have stoppers therein to restrict the ends of the inner tube 68 from moving outside of the outer tube 74. One or more support lines 76 may be provided to support the tubular shower head 60 when in the first position, the second position or any position in between. As illustrated, the support lines 76 may be connected to the ceiling within a shower, although the support line may be disposed in any location or position to aid in the support of the tubular shower head 60.

Figure 5A:
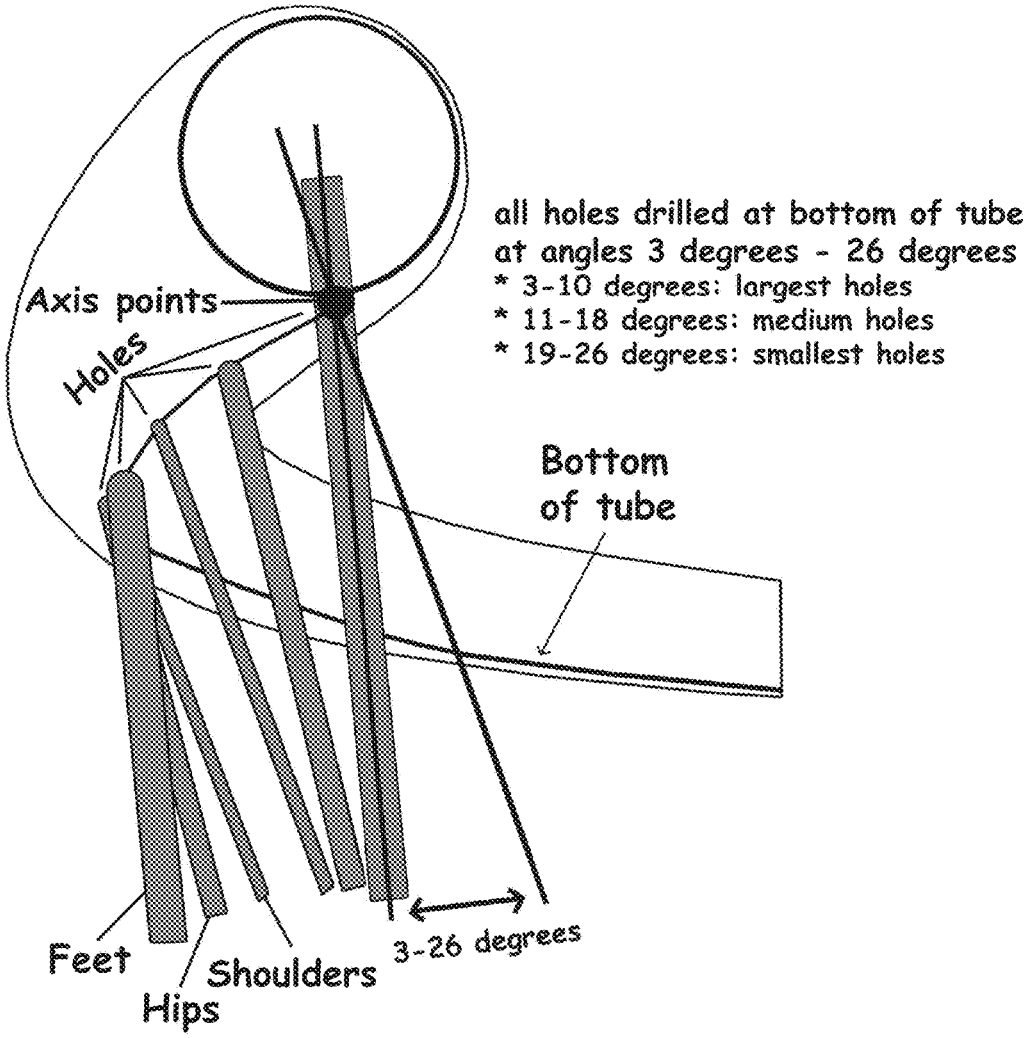
FIGS. 5A-5C illustrate hole and water distribution channels in an embodiment of the present invention.
Figure 5B:
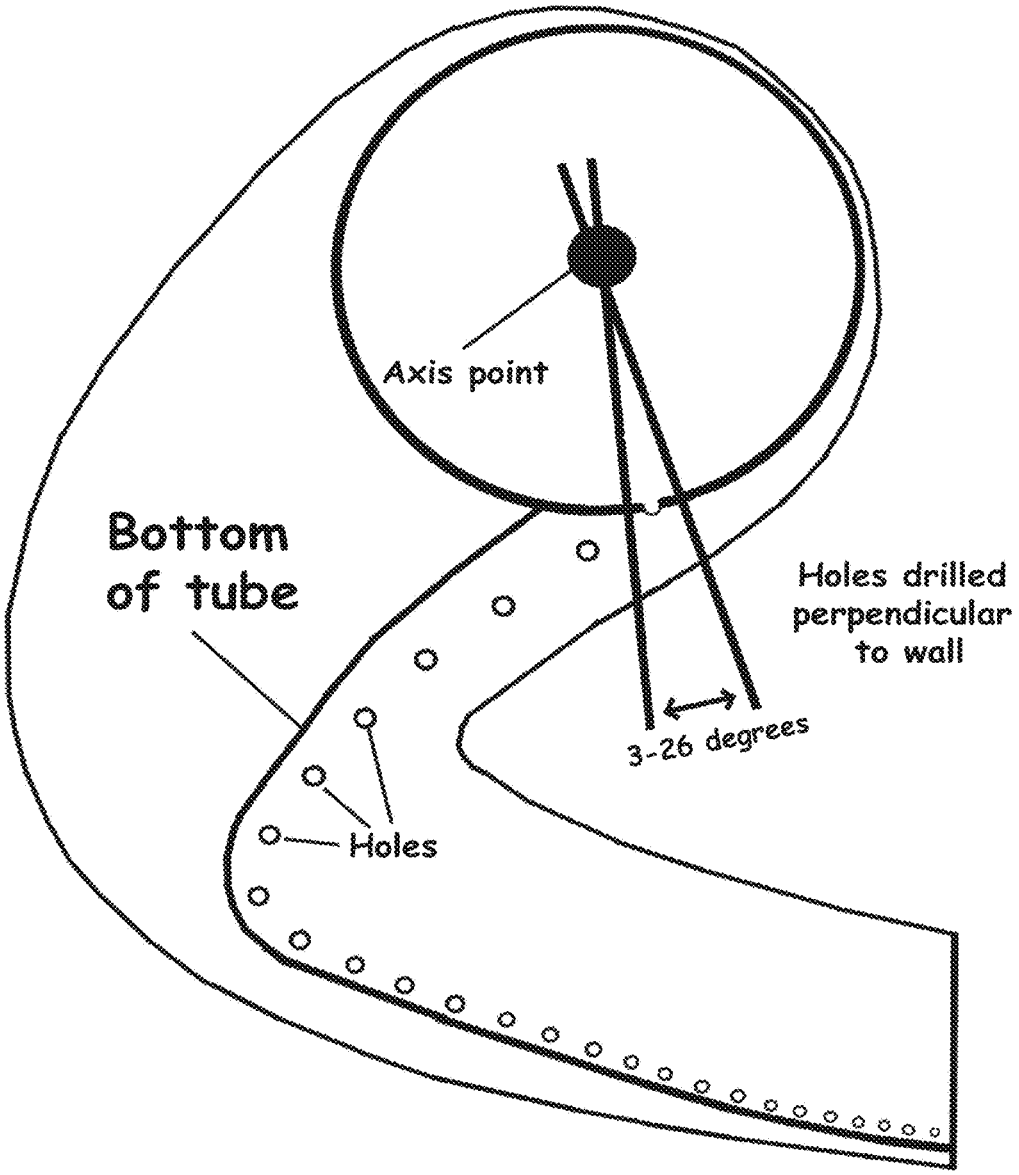
Figure 5C:
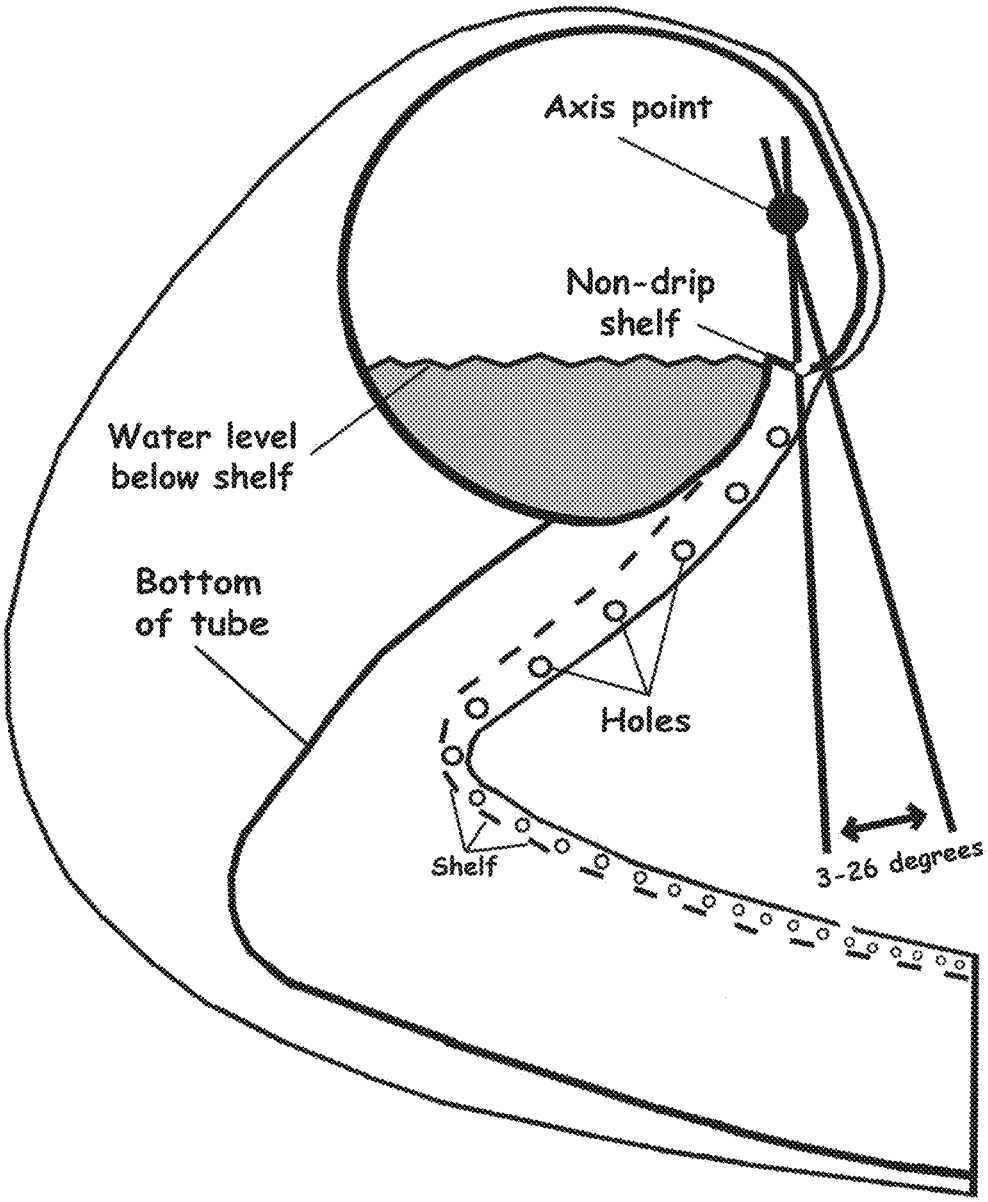

FIGS. 5A, 5B and 5C illustrate embodiments of the present invention, illustrating examples of holes and/or water distribution channels that may be disposed within the tubular shower heads of the present invention. Preferably, the holes may be disposed within the tubular shower heads at or nearly at the bottom of the tube. Thus, water that may be expelled from the holes may effectively drain from the tubular shower head when the water is turned off and pressure is reduced within the tubular shower head. Alternatively, a plurality of holes may be disposed within the tubular shower head at any angle between 0 degrees from bottom of the tube to about 26 degrees toward the insides of the tubular shower heads described herein. For example, given a hoop diameter of about 24 inches, angles of holes within the hoop that are greater than about 26 degrees may cause the water streams to diverse at a point above the floor, thereby not allowing the water droplets to flow over the lower body. Thus, it is preferred that the water distribution from the hoops provide sufficient coverage of the body thereunder without diverging outside of the zone of coverage, even down toward the user's legs and feet, thereby ensuring that the water distribution stay relatively under control, minimizing water spray outside the preferred distribution zone.

Thus, water may be expelled straight down, or nearly so, when the tubular shower head is disposed directly horizontally, and water may be expelled inwardly toward the center of the tubular shower head toward a user standing thereunder. However, the water may preferably expel through the holes and/or channels in such a manner as to fully wet a user thereof, without crossing each other and spraying too far in a direction, such as against the walls of the shower, or outside of where the user may be standing.

In a preferred embodiment, illustrated in FIG. 5A, a plurality of holes are disposed within a tubular shower head, shown in perspective view and in cross section. The plurality of holes may be disposed within the tubular shower head at the lowest point of the tube but the holes themselves may be drilled or otherwise disposed within the tube at angles of between about 3 degrees and about 26 degrees. The largest holes may be disposed at about 3 to about 10 degrees; the medium holes (relative to the other holes) may be disposed within the tubular shower head at angles of between about 11 and about 18 degrees; and the smallest holes maybe be disposed within the tubular shower head at angles of between about 19 and about 26 degrees.

Thus, large streams of water may be expelled through the larger holes that are nearly straight down on the user's legs and feet. Medium streams of water may be expelled through the larger holes that are angled midrange toward the hips of the user, and the smallest streams of water may be expelled through the smallest holes directed to the most degree towards the user's shoulders and neck. Thus, different amounts of water may be directed to different parts of the user's body. In addition, size of the water streams, or water droplets, emanating from a shower head may carry heat in different ways. Smaller droplets may effectively lose heat faster than larger droplets. Thus, the temperature of the water streams may be different depending on the size of the water streams. The larger water streams may feel warmer than the smaller water streams. Thus, a user's body may be showered with different temperatures on different parts of the user's body.

FIG. 5B illustrates an alternate embodiment of the present invention. Specifically, it may be difficult for holes to be disposed within the tubular shower heads at specific angles. Therefore, the holes themselves may be drilled or otherwise disposed directly into the tubular shower heads perpendicular to the tubular shower head wall. However, the holes may be disposed at angles off of zero degrees, with zero degrees being straight down, and any positive degree moving upwardly along the tubular wall inwardly toward the center of the tubular shower head. Specifically, as illustrated in FIG. 5B, the plurality of holes may be drilled perpendicularly into the tubular shower head wall at angles off zero degrees of between about 3 degrees and about 26 degrees.

FIG. 5C illustrates a still further embodiment of the present invention of a tubular shower head in perspective view and in cross-section, of a ridge or shelf disposed on an internal surface of the tubular shower head wall. The holes may be disposed at or above the ridge, inwardly on the tubular shower head wall, so that drips may be eliminated as the water pressure within the tubular shower head is eliminated. Once the water level drops below the ridge or shelf, then water will remain within the tube, or may be directed to a draining area within the tubular shower head to drain out, without dripping on the user as the user is attempting to dry himself or herself.

The tubular shower heads, as described herein, may be fixed to a water distribution pipe, a traditional shower head, the wall, or any other structure. In a preferred embodiment, the tubular shower heads of the present invention may be hingedly connected thereto, so that the horizontal leveling of the tubular shower heads may be adjusted and controlled by a user thereof. If hingedly connected, the tubular shower heads may require support structures that allow a tubular shower head to maintain its level after adjustment thereto. For example, as illustrated in FIG. 3, a counterbalance may be utilized. Alternatively, one or more supports may be utilized to hold a tubular shower head in position after adjustment of the same, as shown and described below with reference to FIGS. 6-7E.

Figure 6:
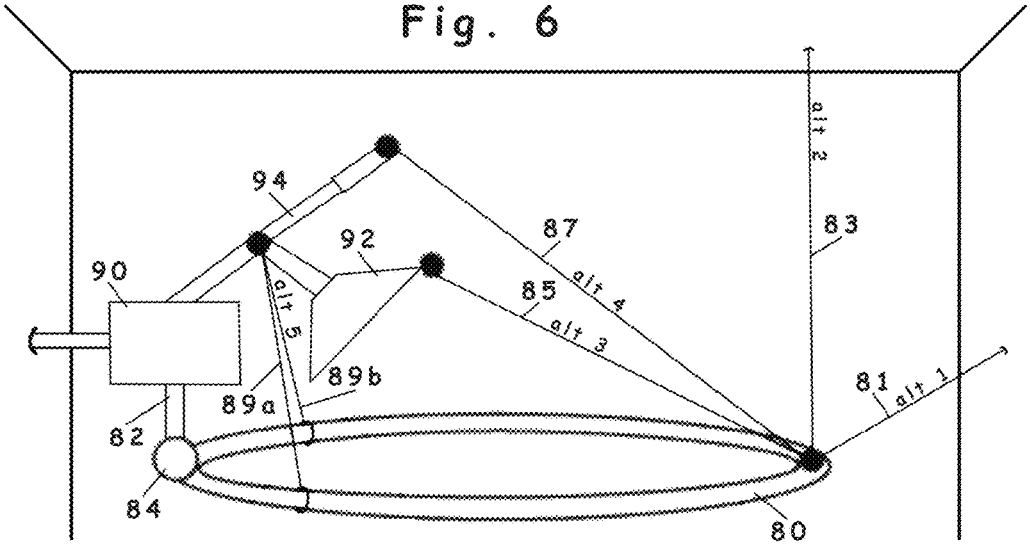
FIG. 6 illustrates a plurality of alternatives for support structures for tubular shower apparatuses in embodiments of the present invention.

Referring now to FIG. 6, a plurality of alternate supports is illustrated. Specifically, tubular shower head 80 is illustrated connected to water distribution pipe 82. To ensure that the tubular shower head 80 maintains its relative position and/or is sufficiently supported, supports may be utilized in various alternate locations to hold the tubular shower head 80. Moreover, the tubular shower head 80 may be connected to a hinge or pivot 84 allowing the position of the tubular shower head 80 to move upwardly and/or downwardly as desired.

In a first alternate embodiment ("alt 1"), the tubular shower head 80 may be supported with a support line 81 (typically a rope, cord, rod, bar, or other structure) extending from the tubular shower head 80 and connected to the far wall in the shower. The support line 81 may be interconnected with a structure on the wall, either removably or permanently, such as a hook, a screw, a suction cup, shower curtain bar, or the like.

In a second alternate embodiment ("alt 2"), the tubular shower head 80 may be supported with a support line 83 extending from the tubular shower head 80 and connected to the ceiling of the shower. As noted above, the support line 83 may be interconnected with a structure on the ceiling, either removably or permanently, such as a hook, a screw, a suction cup or the like.

In a third alternate embodiment ("alt 3"), the tubular shower head 80 may be supported with a support line 85 extending from the tubular shower head 80 and connected to a traditional shower head 92 that may extend from a diverter 90. The support line may be interconnected with a structure on the traditional shower head 92, such as a hook, a screw, a suction cup or the like.

In a fourth alternate embodiment ("alt 4"), the tubular shower head 80 may be supported with a support line 87 extending from the tubular shower head 80 and connected to a rigid support bar 94 that may extend from the traditional shower head 92, the diverter 90, or another structure. The support line 87 may be interconnected with a structure on the rigid support bar 94, such as a hook, a screw, a suction cup or the like.

In a fifth alternate embodiment ("alt 5"), a plurality of support lines 89*a*, 89*b* may extend from the tubular shower head 80 to the water distribution pipe and traditional shower head support of the traditional shower head 92, to another pipe, as apparent to one of ordinary skill in the art.

The support lines, as described herein, may be adjustable and/or retractable, in that they may conform to the proper length, as needed. For example, the single pivot 84 may allow the tubular shower head 80 to be disposed in a horizontal position, or angled to direct the expulsion of water in particular direction, by pivoting the tubular shower head 80 at the pivot 84. The support lines may adjust to allow the movement of the tubular shower head 80, as desired by the user, but still maintain full support of the tubular shower head 80 no matter the position the user places the tubular shower head 80.

Figure 7A:
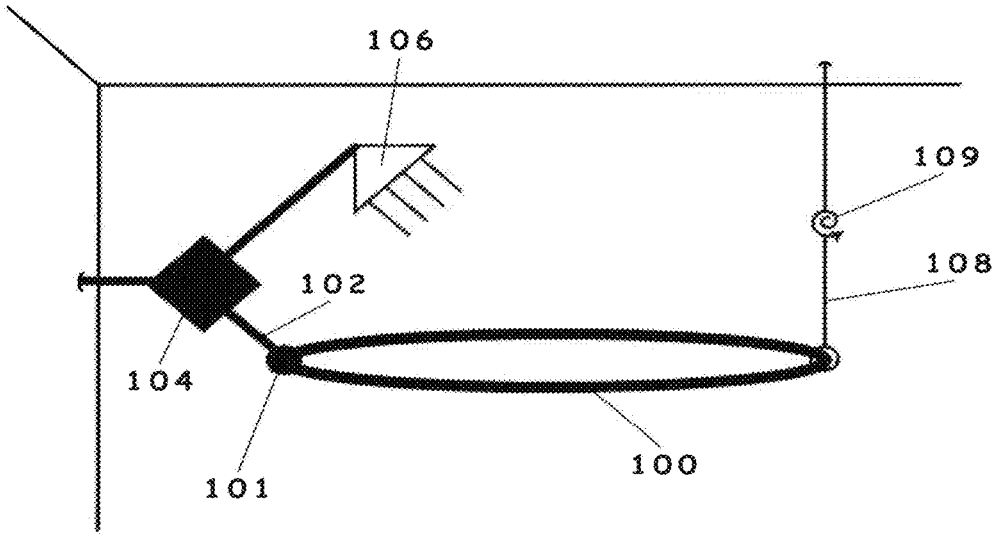
FIGS. 7A-7E illustrate specific alternate embodiments of support structures for tubular shower apparatuses in embodiments of the present invention.

FIG. 7A illustrates an exemplary embodiment of the present invention of a tubular shower head 100 hingedly or pivotally connected to a water distribution pipe 102 via hinge or pivot 101. The water distribution pipe 102 may extend from a diverter 104 that may divert water between the tubular shower head 100 and a traditional shower head 106. The tubular shower head 100 may be adjusted and/or leveled by moving the tubular shower head 100 upwardly or downwardly through hinge or pivot 101. Support for the tubular shower head 100 may be necessary, especially when the tubular shower head 100 fills with water. Specifically, the weight of the tubular shower head 100 and the water therein when water flows therethrough may cause the end of the tubular shower head opposite the hinge of pivot 101 to fall or sag. Therefore support line 108 may be provided that may hold the tubular shower head 100 in place after adjustment thereto. Specifically, support line 108 may be connected to the ceiling (as shown) or to any other structure to hold the tubular shower head 100 in place. Moreover, adjuster 109 may allow a user to lengthen or shorten the support line 108, depending on the adjustment or leveling required of the tubular shower head 100.

Figure 7B:
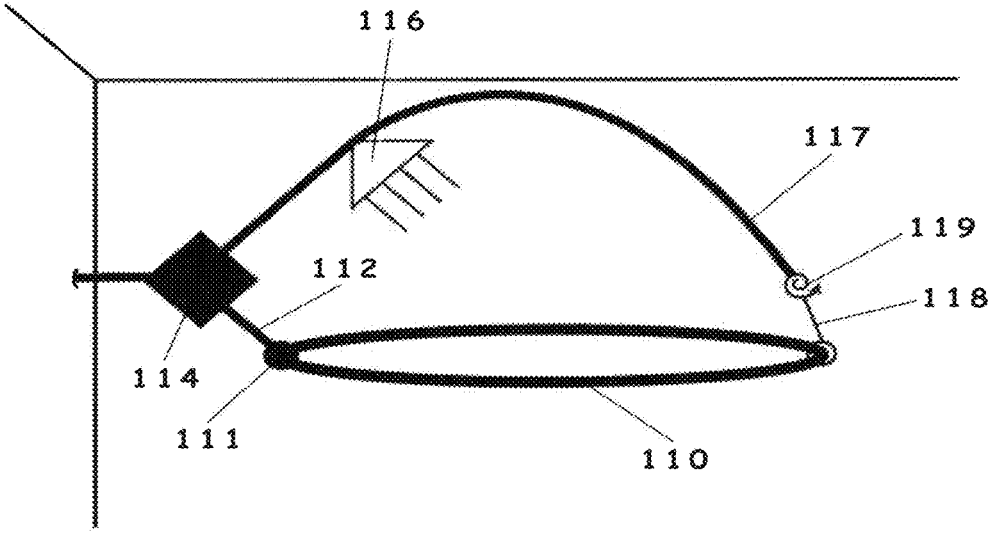

FIG. 7B illustrates a further exemplary embodiment of the present invention of a tubular shower head 110 hingedly or pivotally connected to a water distribution pipe 112 via hinge or pivot 111. The water distribution pipe 112 may extend from a diverter 114 that may divert water between the tubular shower head 110 and a traditional shower head 116. The tubular shower head 110 may be adjusted and/or leveled by moving the tubular shower head 110 upwardly or downwardly through hinge or pivot 111. Support for the tubular shower head 110 may be necessary, especially when the tubular shower head 110 fills with water. Specifically, the weight of the tubular shower head 110 and the water therein when water flows therethrough may cause the end of the tubular shower head opposite the hinge of pivot 111 to fall or sag. Therefore support line 118 may be provided that may hold the tubular shower head 110 in place after adjustment thereto. Specifically, support line 118 may be connected to an extended support pipe 117 extending from the traditional shower head 116 that may arc or otherwise extend from the traditional shower head 116 toward the end of the tubular shower head opposite the hinge or pivot 111. Moreover, adjuster 119 may allow a user to lengthen or shorten the support line 118, depending on the adjustment or leveling required of the tubular shower head 110.

Figure 7C:
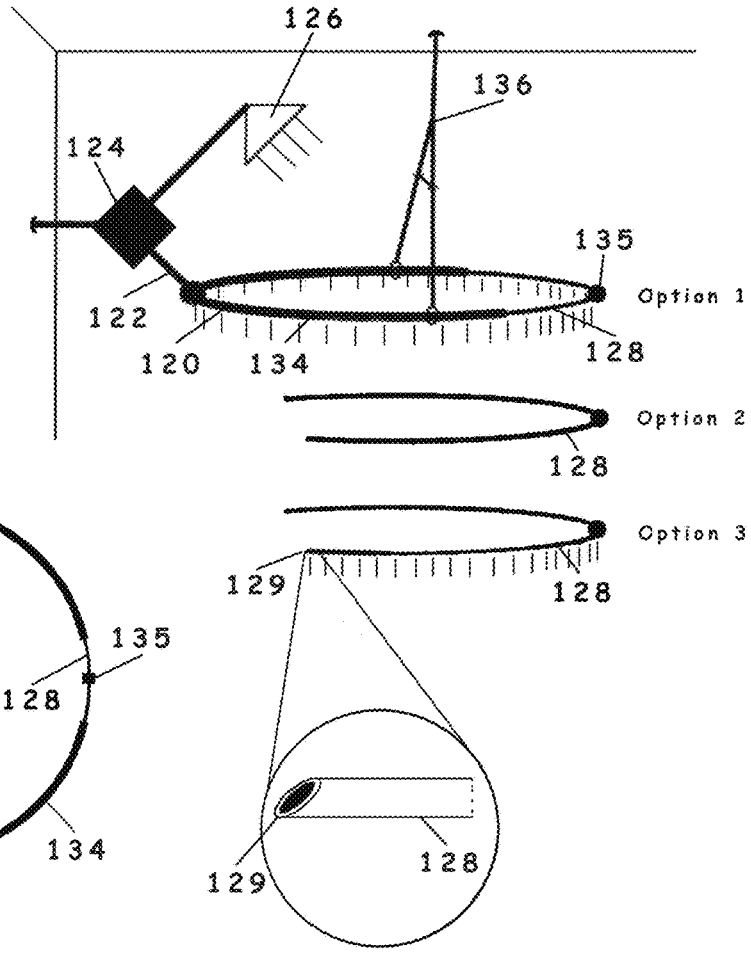
Figure 7D:
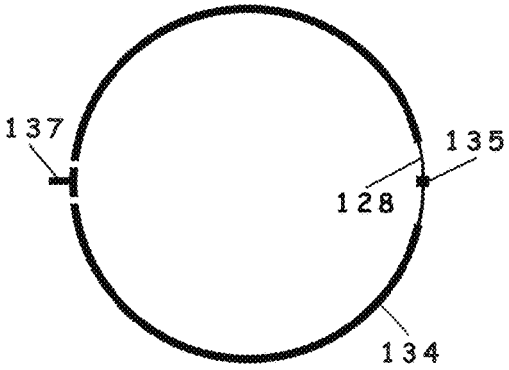

FIGS. 7C and 7D illustrate a still further embodiment of the present invention of a single hinged or pivotable tubular shower head 120 being bifurcated to allow an inner tube 128 to extend from an outer tube 134, as noted above with reference to FIG. 4. As illustrated, centering grommet or stopper 135 may be positioned at a midpoint of the inner tube 128 to ensure that the inner tube 128 is disposed within the outer tube 134 evenly on both sides of the centering grommet or stopper 135. This ensures that one end of the inner tube 128 is not pushed completely against a T-joint 137 that may extend and connect to the water distribution pipe 122. If the inner tube 128 is pushed completely against the T-joint 137, water may be restricted from freely flowing within the outer tube 134, thereby restricting water from expelling from the holes and/or water distribution channels disposed within the outer tube 134.

In an alternative embodiment, one or both of the ends 129 of the inner tube 128 may be tapered such that the ends 129 of the inner tube 128 do not fully engage the T-joint 137 within the outer tube 134. Thus water may have sufficient space within the outer tube 134 to flow into the outer tube 134 to expel freely from the holes and/or water distribution channels disposed therein.

As illustrated in FIG. 7C, Option 1 is shown whereby holes are provided on both sides of the centering grommet or stopper 135, allowing water to flow out of the inner tube 128. Option 2 illustrates an alternate embodiment whereby the inner tube 128 has no holes therein, and water does not flow therefrom. This option provides a tubular shower head whereby only the outer tube 134 allows water to flow therefrom, and a large arcuate portion of the ring formed by the inner tube 128 and the outer tube 134 has water flowing therefrom. Finally, Option 3 illustrates an alternate embodiment, whereby the inner tube 128, on one side of the centering grommet or stopper 135, may have no holes therein, whereby no water flows therefrom, allowing for a tubular shower head whereby an arcuate portion thereof has no water flowing therefrom. Specifically, Option 3 incorporates both Options 1 and 2 together.

Figure 7E:
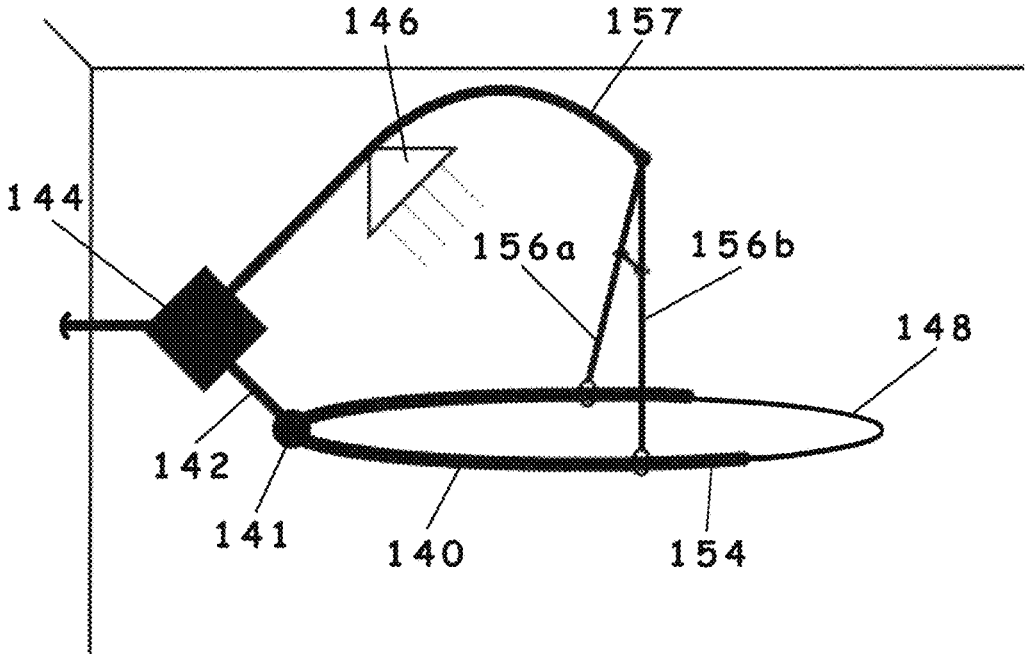

Referring now to FIG. 7E, an alternate exemplary embodiment of the present invention is shown and described herein. Specifically, tubular shower head 140 may be bifurcated, as described above, so that the tubular shower head 140 includes an inner tube 148 and an outer tube 154, having the same or similar functionality as provided above with respect to FIGS. 7C and 7D. The tubular shower head 140 may be hingedly or pivotally connected to water distribution pipe 142 via hinge or pivot 141, which may extend from diverter 144. Support lines 156*a*, 156*b* may support tubular shower head 140, and connect to extension bar 157 that may extend from traditional shower head 146, thereby providing support for the tubular shower head 140, as necessary.

Figure 8:
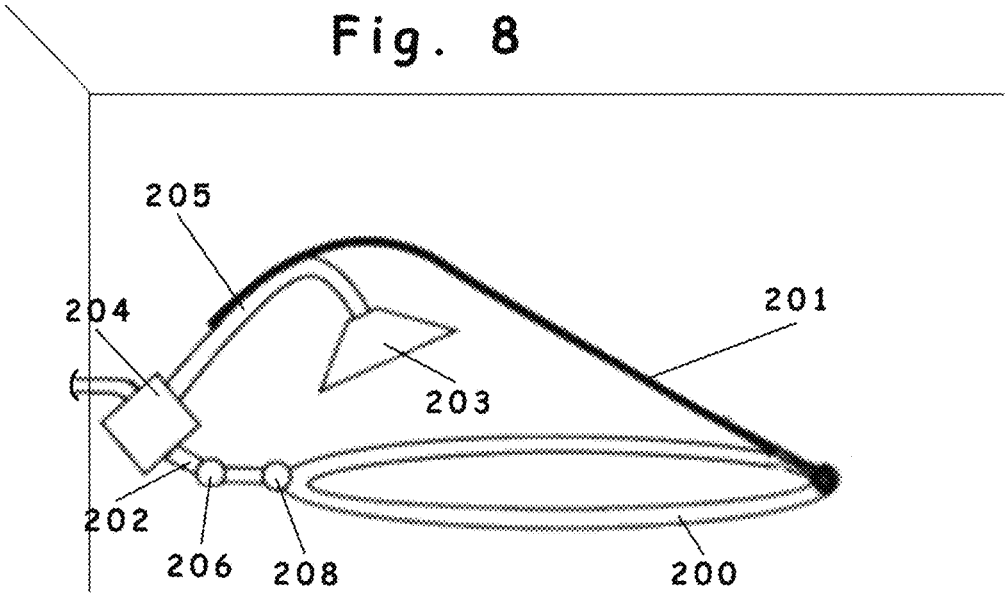
FIG. 8 illustrates a pivotable tubular shower apparatus and support structure in an embodiment of the present invention.

In an alternate embodiment of the present invention, two or more pivots may be disposed within the pipe leading from the diverter to the tubular shower head of the present invention to allow the tubular shower heads, as disclosed herein, to be angled and/or horizontally leveled, as desired. Specifically, in an alternate embodiment of the present invention, a tubular shower head 200 is illustrated in FIG. 8.

The tubular shower head 200 may be supported by a support line or bar 201 that may be interconnected to a tradition shower head 203 or support pipe 205 of the same. In the embodiment illustrated in FIG. 8, the support line 201 may be rigid, and may hold the tubular shower head 200 in a particular position. Alternatively, the support line 201 may be flexible, allowing some play in the horizontal positioning of the tubular shower head 200. Alternatively, the support line 201 may be a combination of rigid and flexible allowing freedom of movement of the same. The tubular shower head 200 may be interconnected to a water distribution pipe 202 extending from a diverter 204 having a plurality of pivots 206, 208 therein for manipulating the tubular shower head 200 with higher degrees of freedom. Specifically, the tubular shower head 200 may be leveled, as desired, by manipulating the tubular shower heads via the pivots 206, 208 in order to obtain the desired horizontal leveling of the tubular shower head 200. The support line 201 restricts the movement of the tubular shower head 200, helping it maintain its horizontal disposition.

Figure 9:
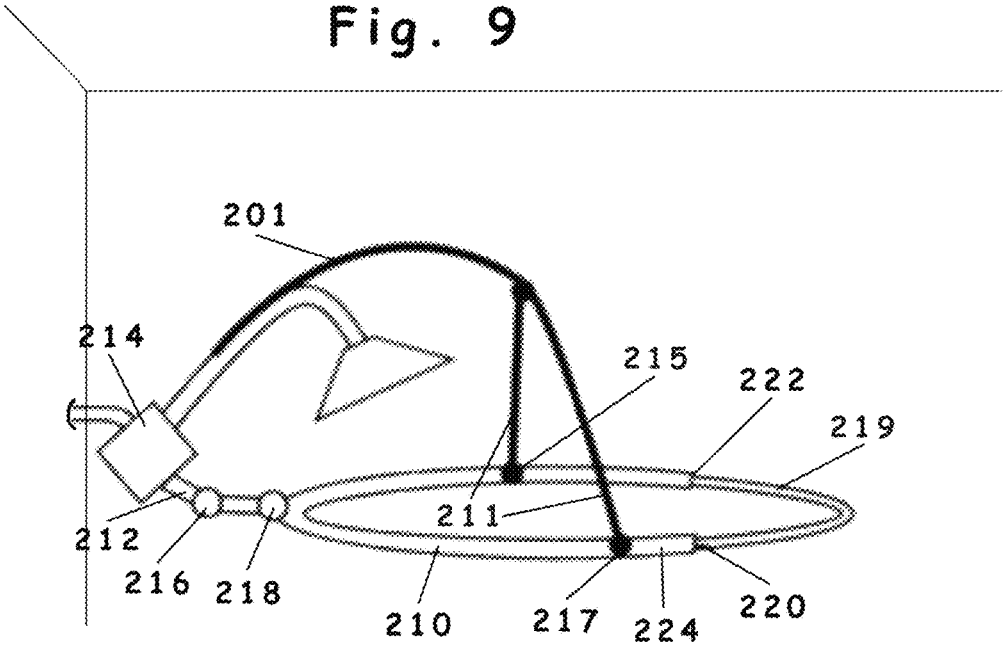
FIG. 9 illustrates an alternate pivotable and expandable tubular shower apparatus and support structure in an embodiment of the present invention.

FIG. 9 illustrates yet another alternate embodiment of the present invention of a tubular shower head 210 that may be supported via a bifurcated support line 211 that may hold opposite sides of the tubular shower head 210, thereby allowing it to maintain its relative location and position. The tubular shower head 210 may further be connected to a water distribution pipe 212 extending from a diverter 214 that may have a plurality of pivots 216, 218 disposed therein for providing freedom of movement. The bifurcated support line 211 may further be connected to the tubular shower head 210 via pivoting connectors 215, 217 to allow the tubular shower head 210 to move as desired.

Moreover, the tubular shower head 210 may include an extendable inner tube 219 that may extend outwardly from an outer tube 224, which may have ends 220, 222 that terminate prior to making a complete circle. The expandable inner tube 219 may be slidably disposed within the outer tube 224, having seals such as O-rings, septa or the like to ensure that water does not spray from the ends 220, 222 but traverse through both the tubular shower head 210 and the expandable inner tube 219. The expandable inner tube 219 may be pulled from the outer tube 224 that may be flexible to widen as the expandable inner tube 219 is pulled therefrom, thereby forming a larger diameter ring as the inner tube 219 is pulled therefrom. Stoppers disposed on or near ends of the inner tube 219 may restrict the movement of the ends of the inner tube 219 out of the outer tube 224 so that, once expanded to a maximum capacity, the inner tube 219 remains connected to the outer tube 224.

Holes and/or water distribution channels may be disposed within both the inner tube 219 and the outer 224 to expel water therefrom to form a ring of water droplets. When the inner tube 219 is fully disposed within the outer tube 224, only the holes and/or water distribution channels in the outer tube 224 may expel water therefrom. When the inner tube 219 is extended from the outer tube 224, the holes and/or water distribution channels in both the inner tube 219 and the outer tube 224 may expel water therefrom to a user standing therebeneath.

Figure 10:
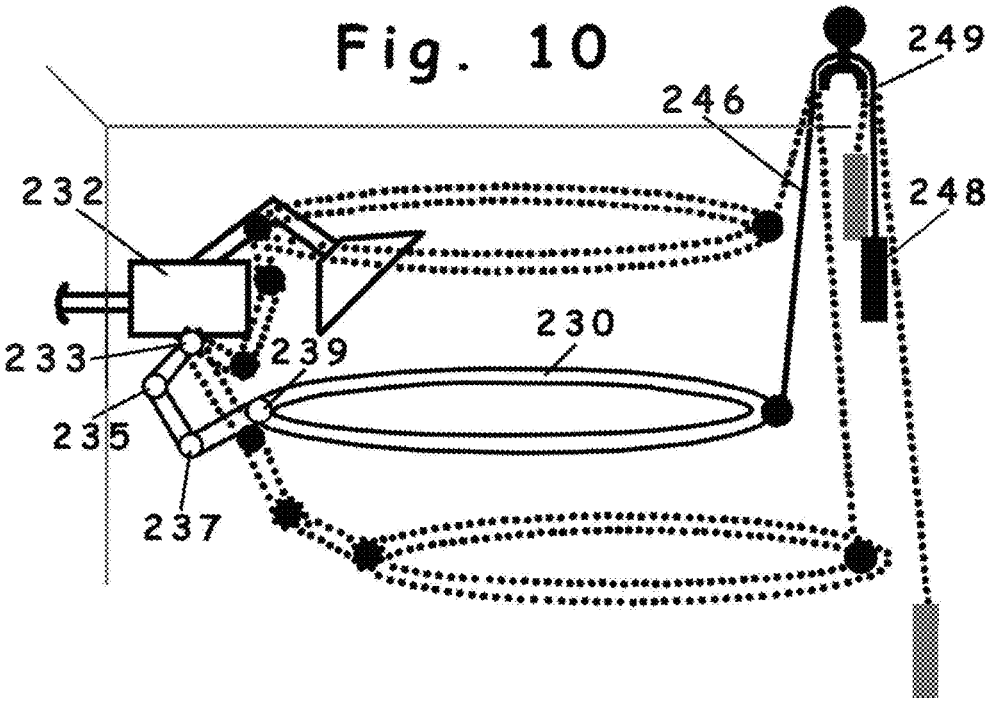
FIG. 10 illustrates a still further alternate pivotable and laterally adjustable tubular shower apparatus in an embodiment of the present invention.

Now referring to FIG. 10, an alternate embodiment of a tubular shower head 230 is illustrated. The tubular shower head 230 may be connected to a water distribution pipe 232 that may have a plurality of pivoting hinges 233, 235, 237, 239 disposed therein. These pivoting hinges may be tensioned so that when moved, the position of the hinge may be maintained without slippage or moving of the same out of position. Thus the plurality of pivoting hinges 233, 235, 237, 239 may be manipulated by a user to give a high degree of freedom of movement upwardly or downwardly, as desired by the user. A support line 246 may be disposed on an opposite end thereof, which may be connected to a weight 248 on an end thereof, and the line may be disposed through a pulley mechanism 249 attached to a ceiling or other rigid structure for supporting the tubular shower head 230 no matter the position of the tubular shower head 230, as desired by the user. FIG. 10 illustrates three possible alternate positions in which the tubular shower head 230 may be disposed depending on the manipulation of the plurality of hinges 233, 235, 237, and 239.

Figure 11:
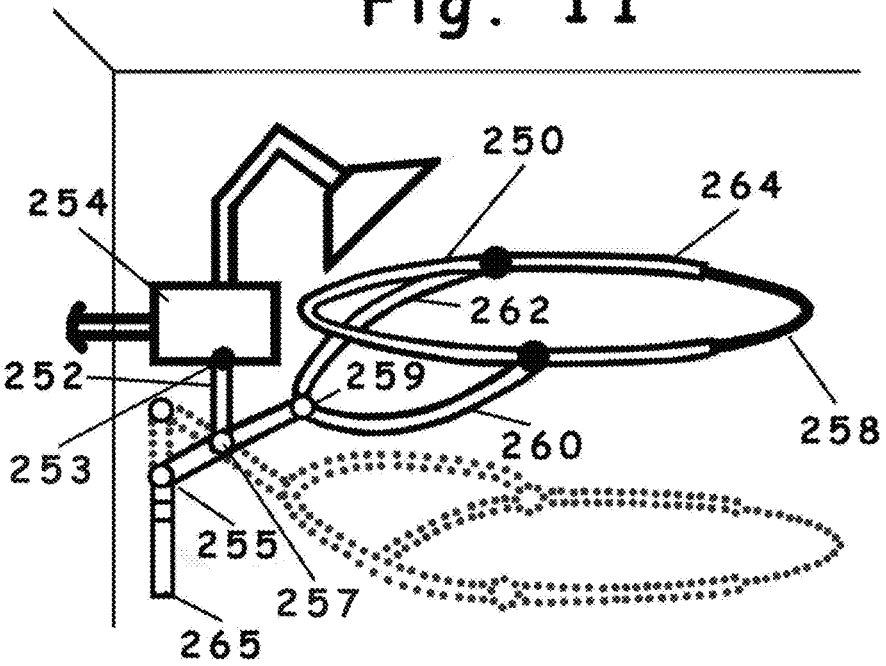
FIG. 11 illustrates an adjustable and expandable tubular shower apparatus in an embodiment of the present invention.

FIG. 11 illustrates an alternate embodiment of a tubular shower head 250 that may be expandable. Specifically, the tubular shower head 250 may include an inner tube 258 and an outer tube 264. The tubular shower head 250 may include first and second extension tubes 260, 262 that may be rotationally connected to the outer tube 264 of the tubular shower head 250. The first and second extension tubes 260, 262 may be linked to a water distribution pipe 252 that may extend from diverter 254. A counterbalance 265 and a plurality of pivot hinges, such as ball pivots 253, 255, 257, 259 may be provided for providing a high degree of freedom of movement of the tubular shower head 250 upwardly or downwardly, the counterbalance 265 allowing the tubular shower head 250 to maintain its relative position when moved by a user.

Figure 12A:
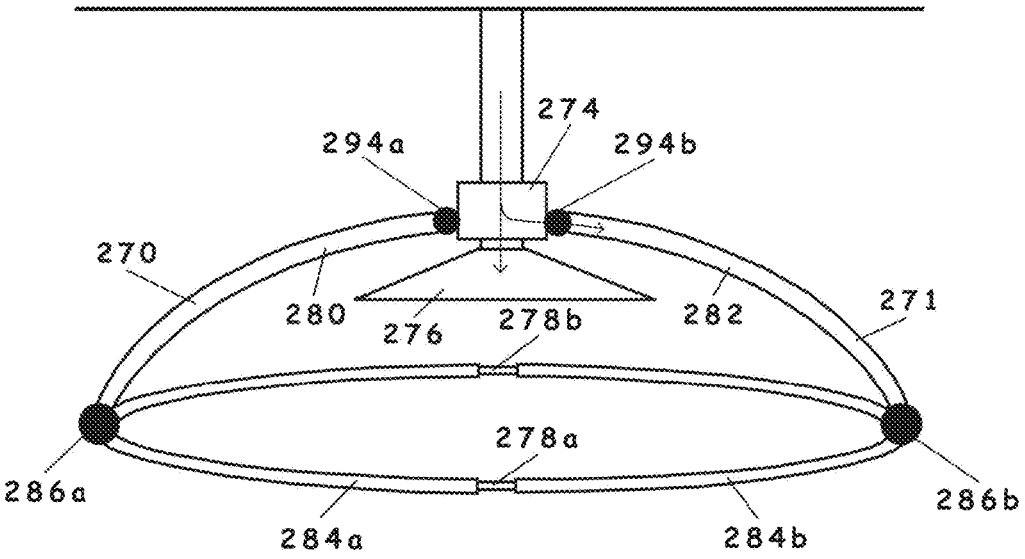
FIGS. 12A-12C illustrates a further alternate expanding tubular shower head apparatus in an embodiment of the present invention.
Figure 12B:
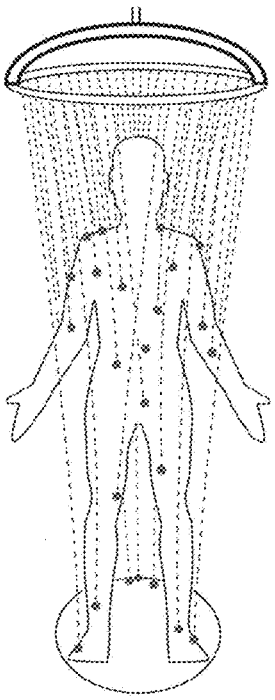
Figure 12C:
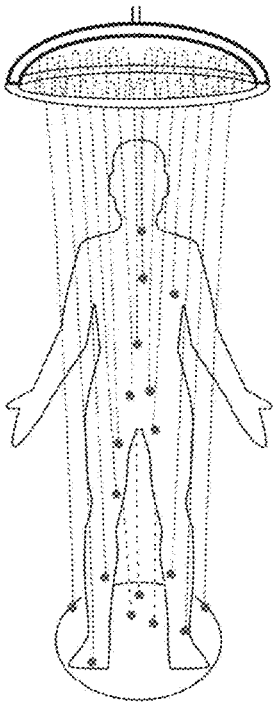

Referring now to FIG. 12A, an alternate embodiment of a tubular shower head 270 is illustrated. The tubular shower head 270 may hang from a ceiling mounted water distribution pipe 271, and therefore hang directly over a user thereof, as illustrated in FIGS. 12B, 12C. Extension pipes 280, 282 may extend from a water diverter 274, which may divert water between the tubular shower head 270 and a traditional shower head 276.

The tubular shower head 270 may include a first inner tube 278*a* and a second inner tube 278*b* extending from within a first outer tube 284*a* and a second outer tube 234*b*. First and second pivot hinges 286*a*, 286*b* may be disposed on opposite sides of first and second outer tubes 284*a*, 284*b*. The first and second pivot hinges 286*a*, 286*b* may connect to first and second extension tubes 280, 282 that may extend from the diverter 274 and allow water to flow therethrough and into tubular shower head 270. First and second diverter pivot hinges 294*a*, 294*b* may connect the extension tubes 280, 282 to the diverter 274.

Thus, the tubular shower head 270 may expand, allowing inner tubes 278*a*, 278*b* to extend outwardly from outer tubes 284*a*, 284*b*, thereby expanding the diameter of the ring of water droplets and, thus, the water droplet sprinkler zone for the user thereunder. Moreover, the pivot hinges, as described herein, may allow for the rotation of the tubular shower head 270 about 180 degrees to form a shower fountain, whereby the water ejects from the tubular shower head upwardly instead of downwardly, as illustrated in FIG. 12C.

Figure 13:
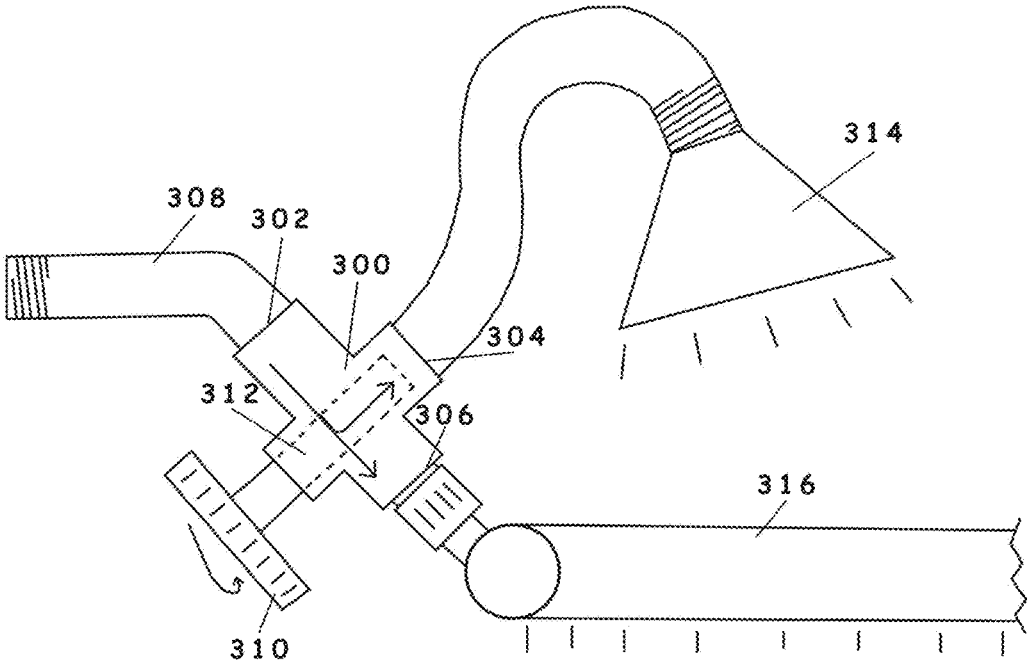
FIG. 13 illustrates a diverter apparatus in an embodiment of the present invention.

Now referring to FIG. 13, an alternate embodiment of a diverter 300 is illustrated. The diverter 300 may have a supply opening 302, a first water exit opening 304 and a second water exit opening 306. The water supply opening 302 may allow water to flow into the diverter from a water supply pipe 308. A knob 310 may allow a user to turn a valve 312 within the diverter 300 to alternately allow water to flow through the first exit opening 304 into a traditional shower head 314 or through the second exit opening 306 into a tubular shower head 316 of the present invention. In one embodiment, the knob 310 allows either full water flow through the first exit opening 304 and into the traditional shower head 314, or full water flow through the second exit opening 306 and into the tubular shower head 316 of the present invention. Moreover, the knob 310 further allows a user to divert some water through the first exit opening 304 and into the traditional shower head 314 and some water through the second exit opening 306 and into the tubular shower head 316 of the present invention so that water may flow out both at the same time.

In an alternate invention, the knob 310 may allow full water to flow out of either the traditional shower head 314 or the tubular shower head 316, but may further allow the user to adjust the water flow and, hence, the water pressure within the traditional shower head 314 or the tubular shower head 316, as desired by the user. This may allow a user to reduce or increase the water pressure for the particular shower head utilized, as illustrated in the graph in FIG. 15.

Figure 14:
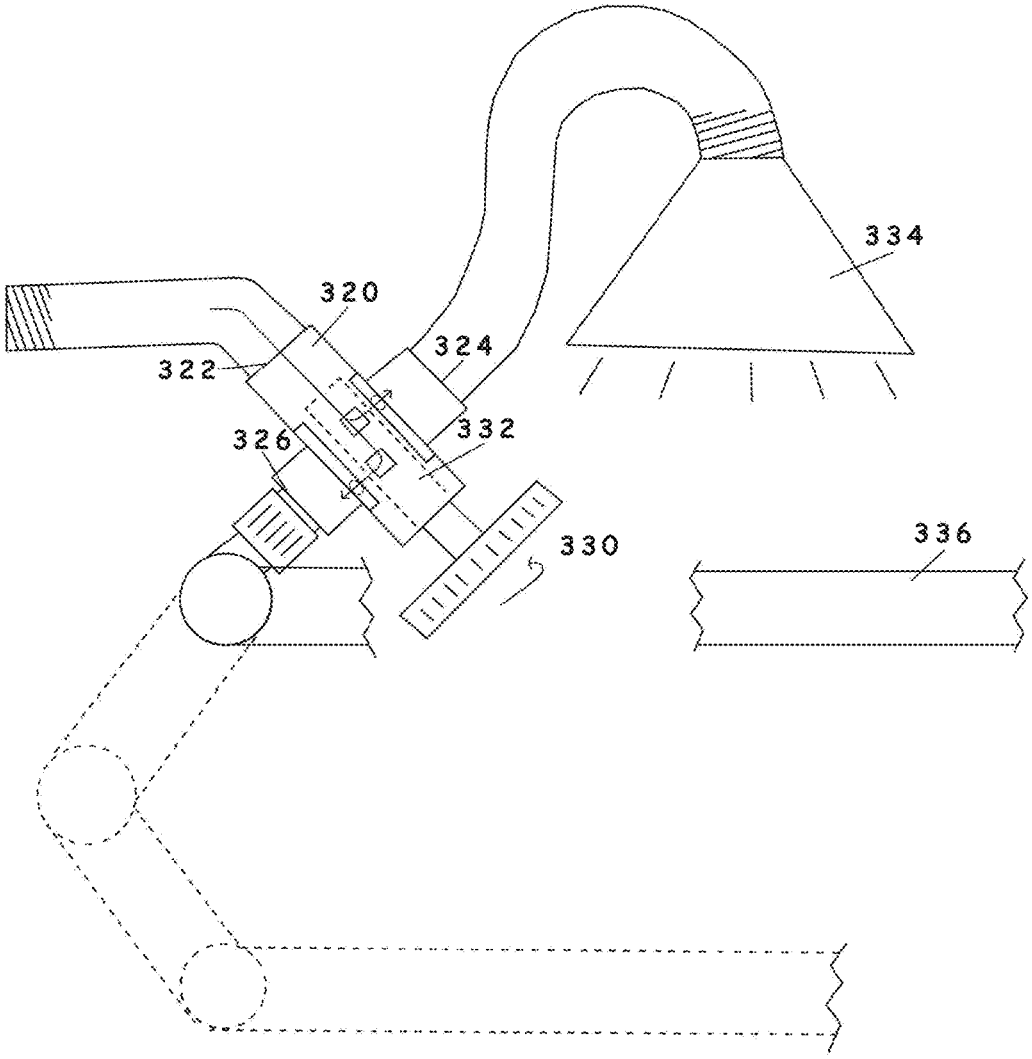
FIG. 14 illustrates an alternate diverter apparatus in an embodiment of the present invention.

FIG. 14 shows an alternate embodiment of the present invention of a water diverter 320 having a supply opening 322, and a first exit opening 324 and a second exit opening 326, each of the first and second exit openings 324, 326 positioned perpendicularly to the supply opening 322. A knob 330 may be provided, interconnected to an internal valve 332 that may allow for the flow of water into a traditional shower head 334 and/or a tubular shower head 336 of the present invention. As illustrated in FIG. 14, the tubular shower head 336 may be disposed on a plurality of pivots to allow for adjustment of the tubular shower head as desired by a user.

As noted above with respect to FIG. 13, in one embodiment, the knob 330 allows either full water flow through the first exit opening 324 and into the traditional shower head 334, or full water flow through the second exit opening 326 and into the tubular shower head 336 of the present invention. Moreover, the knob 330 further allows a user to divert some water through the first exit opening 324 and into the traditional shower head 334 and some water through the second exit opening 326 and into the tubular shower head 336 of the present invention so that water may flow out both at the same time, as illustrated in the graph in FIG. 15. Additionally, a hole may be disposed within the diverter to bleed out cold water prior to allowing water of the desired temperature to flow.

Figure 15:
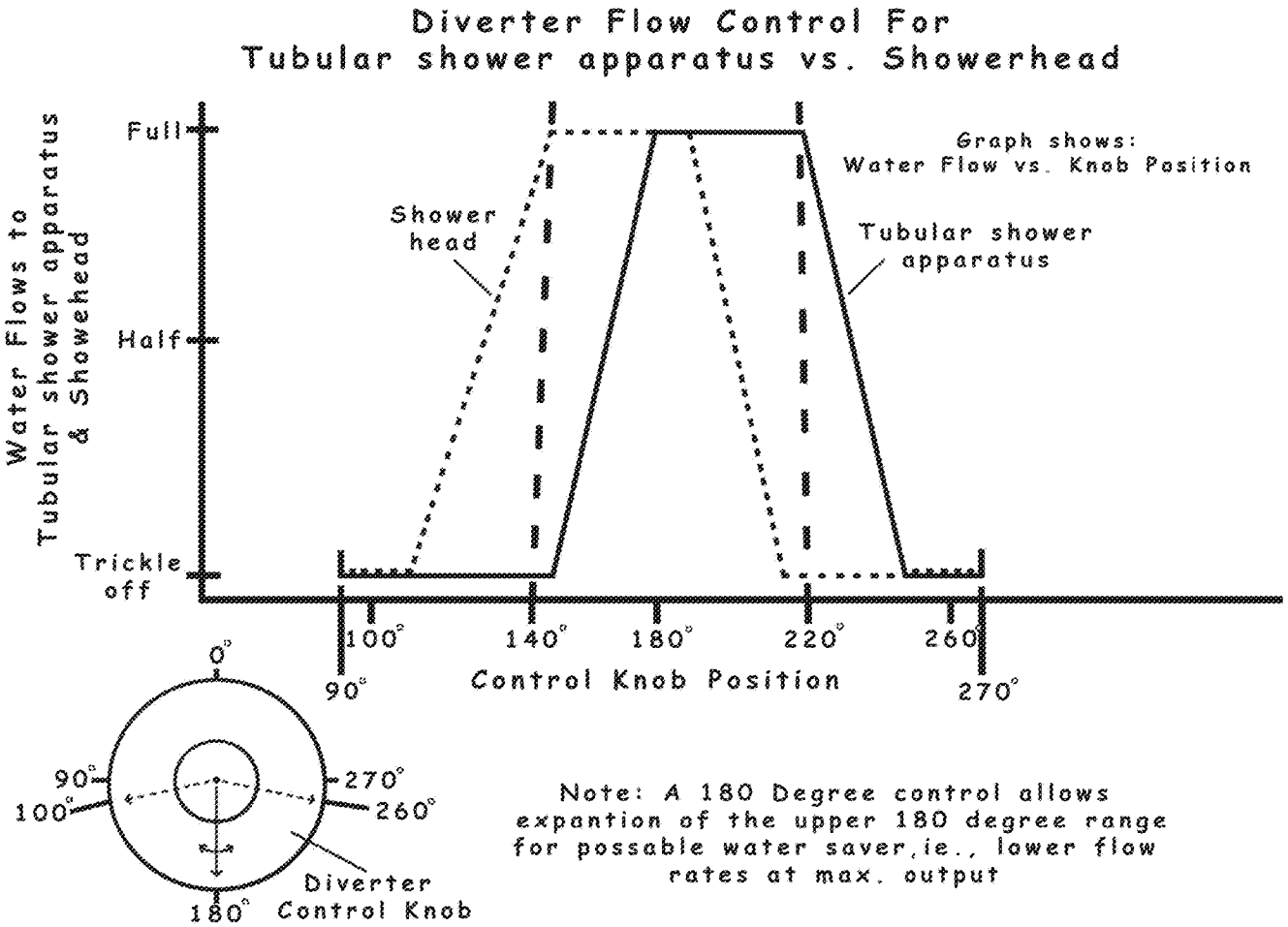
FIG. 15 illustrates diverter flow control in an embodiment of the present invention.

FIG. 15 illustrates an example of diverter flow control in an embodiment of the present invention. Specifically, the diverter may allow water to flow therethrough between about 90 degrees and about 270 degrees. More specifically, the diverter, as illustrated in FIG. 14, may allow a user to control water flowing through the diverter and into a traditional shower head between about 100 degrees and about 140 degrees. When a user turns the knob 330 of the diverter past 140 degrees, the user may allow water to flow through both the traditional shower head and the tubular shower head of the present invention. When the knob 330 reaches about 180 degrees, both the traditional shower head and the tubular shower head may be at full water pressure.

After 180 degrees, the water flow into the traditional shower head may be lessened, until the knob is turned to about 220 degrees, whereupon the water flowing through the traditional shower head is effectively eliminated. After about 220 degrees, the water flow into the tubular shower head of the present invention may be lessened until the knob reaches about 260 degrees, whereupon the water flow into the tubular shower head is effectively eliminated.

Thus, the user may find a combination of flow through both the traditional shower head and/or the tubular shower head as desired.

Figure 16:
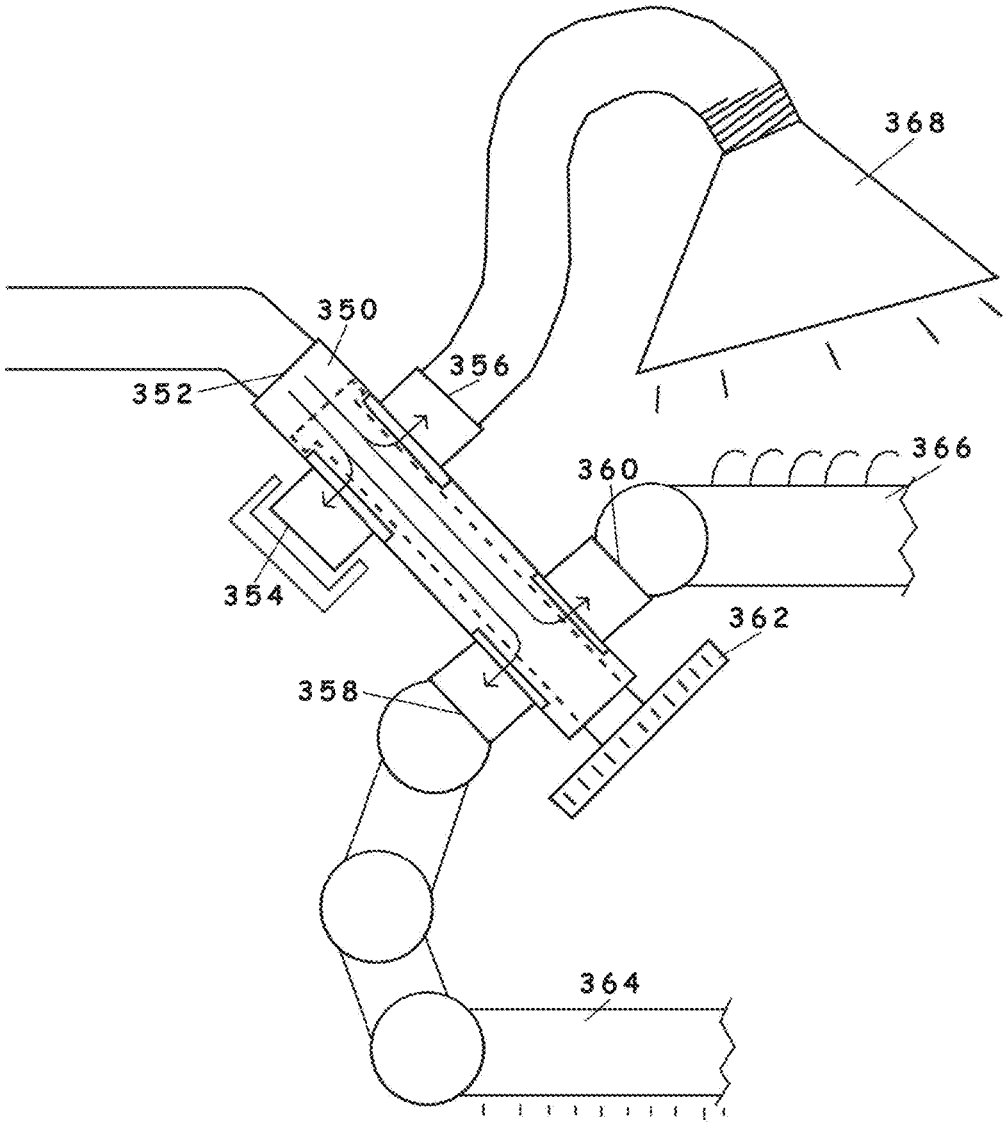
FIG. 16 illustrates a further alternate diverter apparatus in an embodiment of the present invention.

In an alternate embodiment of the present invention, illustrated in FIG. 16, a diverter 350 of the present invention is illustrated. The diverter 350 may allow water to flow alternately through a plurality of exit openings 354, 356, 358, 360, as desired by the user. Specifically, the diverter 350 may have supply opening 352 that allows water to flow thereinto. A knob 362 allows a user to control the flow of water into a traditional shower head 364, or one or a plurality of tubular shower heads 364, 366 of the present invention. For example, tubular shower head 366 may be a fountain-style shower, whereby water may flow out from a top therefrom onto a user standing therebeneath. Alternately, tubular shower head 364 may be a regular tubular shower head whereby water flows from thereunder to a user standing therebeneath. A third tubular or second traditional shower head (not shown) may be utilized, if desired by a user; however, exit opening 354 is shown as being capped and ready for use in the future, if necessary. The knob 362 may allow all of the exit openings 354, 356, 358, 360 to receive water therethrough, or may allow water to flow singly through one of each, or any combination of exit openings in between.

Alternately, a two or more tubular shower heads of the present invention may be controlled from a single diverter, with or without a traditional shower head. For example, a plurality of tubular shower heads may extend from more than one exit openings in a diverter, where the diverter allows full control of the flow of water into one or more of the plurality of tubular shower heads of the present invention. For example, two tubular shower heads of the present invention may be stacked one atop another with necessary supports to allow water to flow from one, from the other, or from both at the same time.

In an alternate embodiment, an outer tube may extend from one exit opening from the diverter, and an inner tube may extend from a second exit opening from the diverter, the inner tube may be disposed within the outer tube. At a point on the outer tube opposite the position of the diverter, the inner tube may extend outwardly from the outer tube to form a second tubular shower head. The second tubular shower head may be disposed within the first tubular shower head formed by the outer tube to allow water to flow onto a user from both the outer and inner tubes. Alternatively, the second tubular shower head may extend away from the outer tube to form a second tubular shower head that may be disposed over a second user, with the outer tube forming a first tubular shower head for allowing water to flow onto a first user.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A shower apparatus comprising:

a tubular shower head having a first arcuate tube, a middle, and a second arcuate tube, wherein the first arcuate tube extends outwardly from a first side of the middle and the second arcuate tube extends outwardly from a second side of the middle, and further wherein the tubular shower head connects at the middle to a pipe via a connector and accepts a flow of water therethrough, a first hole disposed within the tubular shower head that releases the flow of water, a counterbalance for maintaining a position of the tubular shower head, wherein the counterbalance is connected to the tubular shower head;

an arcuate extension tube having a first end and a second end, the first end of the extension tube slidably disposed within the first arcuate tube of the tubular shower head, the second end of the extension tube slidably disposed within the second arcuate tube of the tubular shower head, the tubular shower head and the arcuate extension tube forming an elliptical hoop, wherein the first end of the arcuate extension tube slides in and out of the first arcuate tube of the tubular shower head and the second end of the extension tube slides in and out of the second arcuate tube of the tubular shower head to alternately decrease or increase the size of the elliptical hoop, and wherein the first arcuate tube, the second arcuate tube, and the arcuate extension tube are configured to flex to allow the elliptical hoop to decrease or increase in size when the arcuate extension tube slides in or out of the first or second arcuate tubes, respectively, and further wherein the arcuate extension tube is slidable completely within the first arcuate tube and the second arcuate tube, wherein ends of the first and second arcuate tubes are configured to be disposed adjacent each other when the arcuate extension tube slides completely within the first and second arcuate tubes, wherein the connector is configured to rotate the elliptical hoop between a first position and a second position, wherein the counterbalance is connected to the elliptical hoop and moves with the elliptical hoop when the elliptical hoop rotates between the first position and the second position.

2. The apparatus of claim 1 further comprising a second hole, wherein the first hole is directed downwardly and the second hole is directly inwardly.

3. The apparatus of claim 1 further comprising a slide adjustment to move the apparatus vertically.

4. The apparatus of claim 1 wherein the counterbalance is detachably connected to the tubular shower head.

5. The apparatus of claim 1 wherein the leveling mechanism comprises:

a polygonal wedge disposed adjacent the pipe, an adjusting slot disposed within the polygonal wedge, and a rigid brace connected to the tubular shower head, wherein the rigid brace is disposed within the adjusting slot within the polygonal wedge.

6. The apparatus of claim 5 wherein the adjusting slot spirals inwardly towards the center of the polygonal wedge.

7. The apparatus of claim 1 wherein the leveling mechanism is selected from the group consisting of a brace, a corkscrew, a support line, a screw, a ratchet, a spring, a counter weight, and a gear.

8. The apparatus of claim 1 further comprising a second shower head disposed above the tubular shower head and configured to expel water downwardly through the elliptical hoop of the tubular shower head.

9. The apparatus of claim 8 further comprising a diverter, wherein the diverter connects to the tubular shower head on a first end, connects to the second shower head on a second end, and connects to the pipe on a third end.

10. The apparatus of claim 9 wherein the diverter completely directs the flow of water to a shower head selected from the group consisting of the second shower head, the tubular shower head, and both the second shower head and the tubular shower head.

11. The apparatus of claim 9 further comprising a hole disposed within the diverter that bleeds out cold water.

12. The apparatus of claim 9 wherein the diverter detachably connects to the pipe.

13. The apparatus of claim 1 wherein the tubular shower head detachably connects at the middle to the pipe.

14. The shower apparatus of claim 1 wherein the extension tube comprises at least one hole for water to flow therefrom when in use.

15. A shower apparatus comprising:

a tubular shower head having a first arcuate tube, a middle, and a second arcuate tube, wherein the first arcuate tube extends outwardly from a first side of the middle and the second arcuate tube extends outwardly from a second side of the middle, and further wherein the tubular shower head connects at the middle to a pipe via a connector and accepts a flow of water therethrough, a first hole disposed within the tubular shower head that releases the flow of water; and an arcuate extension tube having a first end and a second end, the first end of the extension tube slidably disposed within the first arcuate tube of the tubular shower head, the second end of the extension tube slidably disposed within the second arcuate tube of the tubular shower head, the tubular shower head and the extension tube forming an elliptical hoop, wherein the first end of the arcuate extension tube slides in and out of the first arcuate tube of the tubular shower head and the second end of the extension tube slides in and out of the second arcuate tube of the tubular shower head to alternately decrease or increase the size of the elliptical hoop, and wherein the first arcuate tube, the second arcuate tube, and the arcuate extension tube are configured to flex thereby allowing the elliptical hoop to decrease or increase in size when the arcuate extension tubes slides in or out of the first or second arcuate tubes, respectively, and further wherein the arcuate extension tube is slidable completely within the first arcuate tube and the second arcuate tube, wherein ends of the first and second arcuate tubes are configured to be disposed adjacent each other when the arcuate extension tube slides completely within the first and second arcuate tubes.

16. The shower apparatus of claim 15 further comprising:

a counterbalance for maintaining a position of the tubular shower head, wherein the counterbalance is connected to the tubular shower head.

* * * * *